US008508437B2

(12) United States Patent
Murata et al.

(10) Patent No.: US 8,508,437 B2
(45) **Date of Patent: *Aug. 13, 2013**

(54) PLASMA DISPLAY DEVICE HAVING A PROTECTIVE LAYER INCLUDING A BASE PROTECTIVE LAYER AND A PARTICLE LAYER

(75) Inventors: Mitsuhiro Murata, Hyogo (JP); Takuji Tsujita, Osaka (JP); Masaharu Terauchi, Hyogo (JP); Toshikazu Wakabayashi, Osaka (JP); Hiroshi Asano, Osaka (JP); Shinichiro Hashimoto, Osaka (JP); Keiji Akamatsu, Osaka (JP)

(73) Assignee: Panasonic Corporation, Osaka (JP)

( * ) Notice: Subject to any disclaimer, the term of this patent is extended or adjusted under 35 U.S.C. 154(b) by 233 days.

This patent is subject to a terminal disclaimer.

(21) Appl. No.: 12/670,004

(22) PCT Filed: Apr. 13, 2009

(86) PCT No.: PCT/JP2009/001686
§ 371 (c)(1),
(2), (4) Date: Jan. 21, 2010

(87) PCT Pub. No.: WO2009/128238
PCT Pub. Date: Oct. 22, 2009

(65) Prior Publication Data

US 2010/0177084 A1 Jul. 15, 2010

(30) Foreign Application Priority Data

Apr. 16, 2008 (JP) ..... 2008-106500

(51) Int. Cl.
*G09G 3/28* (2013.01)
*H01J 17/49* (2012.01)

(52) U.S. Cl.
USPC ..... 345/71; 313/587

(58) Field of Classification Search
USPC ..... 345/60–72; 315/169.4; 313/581–587
See application file for complete search history.

(56) References Cited

U.S. PATENT DOCUMENTS 8,362,979 B2 * 1/2013 Murata et al. ..... 345/71
2002/0075206 A1 6/2002 Takeda et al.

(Continued)

FOREIGN PATENT DOCUMENTS

JP 2000-214823 8/2000
JP 2002-72957 3/2002

(Continued)

OTHER PUBLICATIONS

International Search Report issued Jul. 14, 2009 in International (PCT) Application No. PCT/JP2009/001686.

*Primary Examiner* — Chanh Nguyen
*Assistant Examiner* — Navin Lingaraju
(74) *Attorney, Agent, or Firm* — Wenderoth, Lind & Ponack, L.L.P.

(57) ABSTRACT

A plasma display device has a crystal particle made of MgO single crystal where the cathode luminescence emission spectrum exhibits a desired characteristic, and displays an image by a driving method in the initializing period. The initializing period has the first half for applying the voltage, which gradually increases from a first voltage and to a second voltage, to a second electrode, and the latter half for applying the voltage, which gradually decreases from a third voltage and to a fourth voltage.

7 Claims, 17 Drawing Sheets

(56) References Cited

U.S. PATENT DOCUMENTS

| | | | | |
|---|---|---|---|---|
| 2004/0085262 | A1* | 5/2004 | Lee | 345/41 |
| 2006/0284559 | A1 | 12/2006 | Naoi et al. | |
| 2007/0216603 | A1* | 9/2007 | Kong et al. | 345/60 |
| 2007/0222385 | A1* | 9/2007 | Kim et al. | 313/582 |
| 2007/0262923 | A1* | 11/2007 | Kobayashi et al. | 345/60 |
| 2008/0018565 | A1* | 1/2008 | Choi et al. | 345/68 |
| 2008/0061692 | A1* | 3/2008 | Miura et al. | 313/582 |
| 2008/0157672 | A1* | 7/2008 | Tsujita et al. | 313/586 |
| 2008/0160346 | A1* | 7/2008 | Terauchi et al. | 428/702 |
| 2009/0256478 | A1* | 10/2009 | Kawasaki et al. | 313/582 |
| 2010/0308710 | A1* | 12/2010 | Chu et al. | 313/489 |

FOREIGN PATENT DOCUMENTS

| | | |
|---|---|---|
| JP | 2006-54158 | 2/2006 |
| JP | 2006-147417 | 6/2006 |
| JP | 2007-48733 | 2/2007 |

* cited by examiner

PLASMA DISPLAY DEVICE HAVING A PROTECTIVE LAYER INCLUDING A BASE PROTECTIVE LAYER AND A PARTICLE LAYER

THIS APPLICATION IS A U.S. NATIONAL PHASE APPLICATION OF PCT INTERNATIONAL APPLICATION PCT/JP2009/001686.

TECHNICAL FIELD

The present invention relates to a plasma display panel, a driving method, and a driving device that are used for image display in a computer or a television.

BACKGROUND ART

Recently, a plasma display panel (hereinafter referred to as "PDP") used for image display in a computer or a television has been demanded to be not only enlarged, thinned, and lightened in weight, but also increased in definition to achieve high image quality.

In order to display a high-quality image by controlling the panel so that light emission is secured in a discharge cell to emit light and no light emission is secured in a discharge cell to emit no light, a certain address operation is required within an assigned time. For this purpose, a panel capable of being driven at a high speed has been developed, and a driving method and driving circuit for exploiting the performance of the panel and displaying a high-quality image have been studied.

FIG. 24 is an example of a waveform chart of conventional driving voltage applied to each electrode of the PDP. FIG. 24 shows a conventional example of the driving voltage waveform in subfields. FIG. 24 shows a driving waveform of scan electrodes (SCN1-n in FIG. 24), a driving waveform of sustain electrodes (SUS1-n in FIG. 24), and a driving waveform of address electrodes (D1-m in FIG. 24). Before address period 32 when address discharge for selecting a lit cell is performed, wall charge desired for address discharge is accumulated by weak discharge in the initializing period. The first subfield (hereinafter referred to as "SF") in one field has all-cell initializing period 31 when all-cell initializing operation for causing initializing discharge in all the discharge cells to display an image is performed. The other subfields have selective initializing period 34 when selective initializing operation for causing initializing discharge only in the cell having undergone all-cell initializing operation or sustain discharge in the preceding subfield is performed.

In address period 32, a cell to be lit by address discharge is selected. In sustain period 33, sustain operation of sustaining light emission only in the cell having undergone the address discharge in address period 32 is performed. In the initializing operation in the first half of all-cell initializing period 31 in the first SF, all sustain electrodes SUS1 through SUSn and all address electrodes D1 through Dm are kept at 0 V. Ramp voltage gradually increasing to voltage Vh, which is threshold voltage Vff or higher, is applied to all scan electrodes SCN1 through SCNn, and gas discharge occurs in a discharge section of the PDP. Here, at threshold voltage Vff, the discharge starts between scan electrodes SCN1 through SCNn and sustain electrodes SUS1 through SUSn and between scan electrodes SCN1 through SCNn and address electrodes D1 through Dm. Sustain electrodes SUS1 through SUSn are paired with scan electrodes SCN1 through SCNn, and address electrodes D1 through Dm intersect with them. The discharge is weak discharge where ionization multiplication increases temporally gradually. The charge generated by the weak discharge is accumulated as wall charge on a wall surface surrounding the discharge section so as to reduce the electric field inside and on the surface of the discharge section around data electrodes, the scan electrodes, and the sustain electrodes. Negative charge is accumulated as wall charge on the surface of a protective film near the scan electrodes, and positive charge is accumulated as wall charge on the surface of a protective film near the sustain electrodes and on the surface of a phosphor layer near the address electrodes. In the initializing operation in the latter half of all-cell initializing period 31, all sustain electrodes SUS1 through SUSn are kept at positive voltage Ve. Ramp voltage gradually decreasing to voltage Vbt, which is threshold voltage Vpf or lower, is applied to all scan electrodes SCN1 through SCNn, and gas discharge occurs in a discharge section. Here, at threshold voltage Vpf, the discharge starts between scan electrodes SCN1 through SCNn and sustain electrodes SUS1 through SUSn and between scan electrodes SCN1 through SCNn and address electrodes D1 through Dm. Sustain electrodes SUS1 through SUSn are paired with scan electrodes SCN1 through SCNn, and address electrodes D1 through Dm intersect with them. The discharge is also weak discharge where ionization multiplication increases temporally gradually. This weak discharge reduces the negative charge accumulated on the surface of the protective film near the scan electrodes, and the positive wall charge accumulated on the surface of the protective film near the sustain electrodes.

In a state where all electrodes are grounded after the all-cell initializing operation, a desired potential difference (hereinafter referred to as "wall potential") required for selecting a lit cell with address discharge is caused by the accumulated wall charge between the scan electrodes and the address electrodes and between the scan electrodes and the sustain electrodes. The initializing operation means operation of producing, with discharge, a desired wall charge for controlling the address discharge. In address period 32, voltage lower than that of the data electrodes and the sustain electrodes is applied to the scan electrodes. Voltage is applied only to the address electrode of the cell to be lit so as to cause the voltage difference of the same sign as that of the wall potential between the scan electrode and the address electrode. Thus, address discharge occurs. Negative charge is accumulated as wall charge on the surface of the phosphor layer and on the surface of the protective film near the sustain electrodes, and positive charge is accumulated as wall charge on the surface of the protective film near the scan electrodes. In a state where all electrodes are grounded after the address operation, a desired wall potential required for causing sustain discharge between the scan electrodes and the sustain electrodes is generated by wall charge.

In sustain period 33, firstly, voltage higher than that of the sustain electrodes is applied to the scan electrodes to cause discharge. Then, voltage is applied so that the polarity of the scan electrodes and the polarity of the sustain electrodes interchange, thereby intermittently keeping light emission. In selective initializing period 34, rectangular waveform erasing voltage where the phase difference time width from the scan electrodes is narrow is applied to the sustain electrodes, thereby causing the incomplete discharge to extinguish a part of the wall charge and preparing for the initializing operation of the next SF. In the driving method of the conventional PDP, an image is displayed by a sequence of the initializing period, the address period, and the sustain period.

The discharge characteristic of the panel largely depends on the characteristic of the protective layer. Especially, in order to improve the electron emission performance and charge retention performance affecting the possibility of high-speed driving, the material, structure, and manufacturing method of the protective layer have been studied widely. Patent literature 1, for example, discloses a panel having a magnesium oxide layer that is produced by gas phase oxidation of magnesium vapor and has a cathode luminescence emission peak at a wavelength of 200 to 300 nm. Patent literature 1 also discloses an electrode driving circuit for sequentially applying scan pulses to one electrode of each of the display electrode pairs forming all display lines in the address period and for applying, to the data electrode, the address pulse corresponding to the display line to be applied with the scan pulse.

In the conventional PDP (conventional example 1), in all-cell initializing period 31 for accumulating a desired wall charge with weak discharge, the number of charged particles causing discharge reduces absolutely in the following cases:

- the density of ions and electrons (charged particles causing ionization multiplication) initially existing in the discharge section is low; or
- phosphors and barrier ribs apt to absorb the charge of the charged particles surround the discharge section.

Therefore, occurrence probability of strong discharge (hereinafter referred to as "strong discharge") where ionization multiplication increases temporally sharply becomes high. When the strong discharge occurs, more excessive wall charge (which substantially cancels the electric field in the discharge section) than the desired wall charge is accumulated, and abnormal wall potential higher than a desired wall potential occurs. Disadvantageously, the action of the abnormal wall potential causes sustain light emission though the cell is unlit in the sustain period, and normal image display is not allowed.

When video display is performed using a high definition PDP, there are the following problems. For example, in a progressive 42-type full high-definition (HD) PDP (1920×1080 pixels) increased in definition, the cell pitch is short and hence the influences of electric field interference with an adjacent cell and scattering of charged particles are increased even when cells are separated from each other by the barrier ribs. In the conventional PDP driving method (conventional example 2) shown in FIG. 24, rectangular waveform voltage is applied in selective initializing period 34, so that erasing discharge becomes strong. Therefore, when the high definition PDP is driven in conventional example 2, the influence of discharge interference between adjacent cells in the initializing period becomes large, a desired wall potential cannot be accumulated in the address operation, and the address operation cannot be performed normally, disadvantageously (for example, patent literature 2).

In the conventional PDP, the electron supply amount for performing stable initializing operation is short in the following cases:

- the pixel pitch is small due to high definition and the ratio of the surface area to the volume of the discharge section is high; and
- the mixing ratio of discharge gas such as xenon or krypton having a large atomic number is increased in order to increase the luminance.

Then, strong discharge occurs in the initializing period, the abnormal wall charge accumulated by the strong discharge causes sustain light emission though the cell is unlit in the sustain period, and hence normal image display is not allowed. This is a first problem.

In the conventional driving method, when the high definition PDP is driven, the influences of electric field interference between adjacent cells and scattering of charged particles in the selective initializing period are large, sustain light emission does not occur though the cell is lit in the sustain period, and normal image display is not allowed. This is a second problem.

The reason why improving the definition makes the first problem larger is described in detail. Following the improvement in definition, the volume of the discharge section per cell decreases, the ratio of the surface area to the volume of the discharge section increases, the energy loss due to re-absorption of the charged particles on the wall surface and due to heating caused by elastic collision increases, and more electric power is required to be supplied from the outside. As a result, the number of charged particles inside the discharge section before the all-cell initializing operation decreases, and the driving voltage increases in each period. When the voltage applied to the electrodes increases, the electric field intensity inside and on the discharge section around the electrodes increases, and the probability of temporally sharply increasing the ionization multiplication becomes higher. As a result, it becomes more difficult to cause the weak discharge used in the conventional initializing operation.

Thus, the number of charged particles inside the discharge section is decreased and the driving voltage is increased by improvement in definition, so that the strong discharge is apt to occur in the initializing period. As a result, it becomes more difficult than the conventional art to normally select a lit cell or an unlit cell in the address period.

The improvement in definition reduces the size of one cell, so that the light shielding factor by the barrier ribs and metal electrodes increases, the luminance reduces, and the whole video becomes dark. As a method of securing the luminance required for high quality image display, a method of increasing the whole pressure of the discharge gas or the mixing ratio of xenon or krypton contributing to the emission of visible light receives attention. For example, it has been studied that the whole pressure is between 180 and 750 Torr inclusive and the xenon partial pressure ratio is 10%, 15%, 20%, 30%, 50%, 80%, 90%, 95%, 98%, or 100%.

The reason why the higher mixing ratio of xenon or krypton makes the first problem larger is described in detail. An element such as xenon or krypton having a large atomic number has small electronic energy (first ionization energy) on its outermost shell, so that secondary electron emission coefficient is extremely smaller than that of helium, neon, argon having large electronic energy on its outermost shell. As a result, the absolute number of electrons supplied from the surface of the protective layer to the discharge section decreases, and the threshold voltage required for starting discharge increases. When the voltage applied to the electrodes increases, the electric field intensity inside and on the discharge section around the electrodes increases, and the probability of temporally sharply increasing the ionization multiplication becomes higher. As a result, it becomes more difficult to cause weak discharge used in the conventional initializing operation.

Also when the partial pressure ratio of xenon or krypton is increased to secure high luminance required for high quality image display, strong discharge is apt to occur in the all-cell initializing period. When strong discharge occurs, the contrast ratio extremely decreases because the light emission intensity by one discharge is strong, and the image quality extremely degrades in video having many low gradation expressions. As a result, it becomes more difficult than the conventional art to normally select a lit cell or an unlit cell in the address period.

[Patent Literature 1] Unexamined Japanese Patent Publication No. 2006-54158

[Patent Literature 2] Unexamined Japanese Patent Publication No. 2000-214823

[Patent Literature 3] Unexamined Japanese Patent Publication No. 2007-48733

SUMMARY OF THE INVENTION

A plasma display device has a plasma display panel and a driving circuit. The plasma display panel has the following elements:

a first electrode and a second electrode;

a dielectric layer formed around the first electrode and the second electrode; and a protective layer formed on a surface of the dielectric layer so that the protective layer faces a discharge section.

Crystal particles containing MgO single crystal particles where ratio Sa/Sb is one or higher are formed on a surface of the protective layer. Here, Sa is the spectral integrated value of the wavelength region of 200 nm or higher and lower than 300 nm in cathode luminescence, and Sb is the spectral integrated value of the wavelength region of 300 nm or higher and lower than 550 nm. A first substrate having at least a part facing the discharge section is faced to a second substrate that has at least a third electrode and a dielectric layer formed around the third electrode, and discharge gas is filled between the first substrate and the second substrate facing each other. The driving circuit drives the plasma display panel by a driving method where one field is formed of a plurality of subfields and each subfield has at least an initializing period and an address period. The initializing period has a first half for applying voltage, which gradually increases from a first voltage to a second voltage, to the second electrode, and a latter half for applying voltage, which gradually decreases from a third voltage to a fourth voltage, to the second electrode.

REFERENCE MARKS IN THE DRAWINGS

Figure 1:
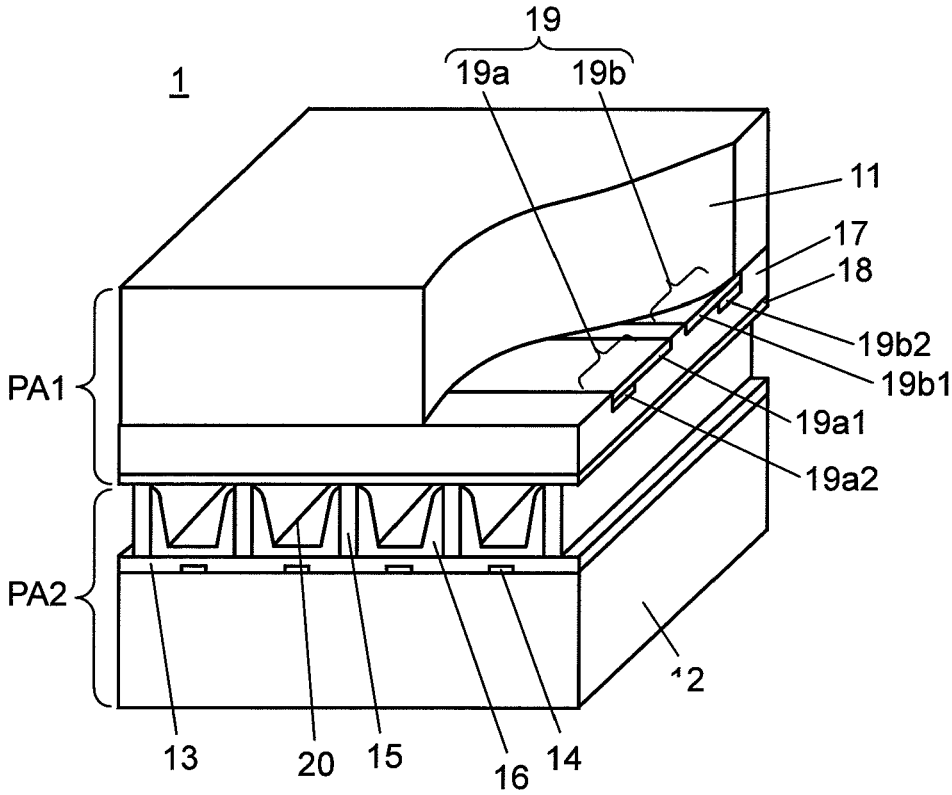
FIG. 1 is a perspective view showing an essential part of a panel in accordance with the present invention.

1 plasma display panel
11 front glass substrate
12 rear glass substrate
13 dielectric layer
14 data electrode
15 barrier rib
16 phosphor layer
17 dielectric layer
17*a* first dielectric layer
17*b* second dielectric layer
18 protective layer

18*a* base protective layer
18*b* crystal particle
18*c* agglomerated particle
19*a*1 scan transparent electrode
19*a*2 scan bus electrode
19*b*1 sustain transparent electrode
19*b*2 sustain bus electrode
20 discharge section
21 scan electrode driving circuit
22 sustain electrode driving circuit
23 address electrode driving circuit
24 timing generating circuit
25 analog/digital (A/D) converter
26 number-of-scan-lines converting section
27 subfield converting section
28 average picture level (APL) detecting section
31 all-cell initializing period
32 address period
33 sustain period
34 selective initializing period
35 initializing period

DETAILED DESCRIPTION OF PREFERRED EMBODIMENTS

Recently, a plasma display device having not only a large screen but also high definition has been demanded. For example, a high definition plasma display device of 1920 pixels and 1080 lines, and an extremely high definition plasma display device of 2160 line or 4320 lines have been demanded. Thus, while the number of lines is increased, the number of subfields for displaying smooth gradation also needs to be secured. Therefore, the time assigned to the address operation per line is apt to decrease. In order to perform certain address operation within the assigned time, a plasma display device is demanded that has a panel allowing stable address operation of higher speed than a conventional art, its driving method, and a driving circuit achieving it.

The present invention simultaneously addresses the first problem of the conventional PDP and the second problem of the conventional driving method. In the present invention, rapid and stable address operation is performed, the flicker or roughness of an image is remarkably improved, and a scan integrated circuit (IC) can be inexpensive by reducing the number of components of an address electrode driving circuit and reducing the voltage of a scan pulse. The present invention can provide a plasma display device achieving high definition, power saving, and low price.

A plasma display device in accordance with an exemplary embodiment of the present invention will be described hereinafter with reference to the accompanying drawings.

(First Exemplary Embodiment)

FIG. 1 is a perspective view showing a basic structure of a panel of a plasma display device in accordance with the present invention. In plasma display panel 1, front plate PA1 as a first substrate and rear plate PA2 as a second substrate are faced to each other, and their periphery is sealed with a sealing material made of low-melting glass. Discharge section 20 inside plasma display panel 1 is filled with discharge gas such as xenon at a pressure of 100 to 600 Torr.

A plurality of display electrode pairs 19 are disposed in parallel on front glass substrate 11 of front plate PA1. Each display electrode pair 19 is formed of scan electrode 19*a* as a second electrode and sustain electrode 19*b* as a first electrode. Dielectric layer 17 is formed on front glass substrate 11 so as to cover display electrode pairs 19. Dielectric layer 17 is formed by applying low-melting glass or the like mainly made of lead oxide, bismuth oxide, or phosphorous oxide by screen printing or die coating, and firing it. Protective layer 18 mainly made of magnesium oxide is formed on the surface of dielectric layer 17. Scan electrode 19*a* has scan transparent electrode 19*a*1 made of indium tin oxide or tin oxide, and scan bus electrode 19*a*2 disposed on scan transparent electrode 19*a*1. Sustain electrode 19*b* has sustain transparent electrode 19*b*1, and sustain bus electrode 19*b*2 disposed on it. Scan bus electrode 19*a*2 is disposed for applying conductivity in the longitudinal direction of scan transparent electrode 19*a*1. Sustain bus electrode 19*b*2 is disposed for applying conductivity in the longitudinal direction of sustain transparent electrode 19*b* 1. Scan bus electrode 19*a*2 and sustain bus electrode 19*b*2 are made of a conductive material mainly containing silver.

A plurality of data electrodes 14 as third electrodes are arranged mutually in parallel in the direction orthogonal to display electrode pairs 19 on rear glass substrate 12 of rear plate PA2, and are covered with dielectric layer 13. Barrier ribs 15 are formed on dielectric layer 13. Phosphor layers 16 for emitting red, green, blue lights with ultraviolet rays are formed on dielectric layer 13 and on side surfaces of barrier ribs 15, respectively. Discharge cells are formed at the intersecting positions of display electrode pairs 19 and data electrodes 14, and a set of discharge cells having phosphor layers 16 for red, green, and blue form a pixel for color display. Dielectric layer 13 is not essential, but a structure having no dielectric layer 13 may be employed.

Figure 2:
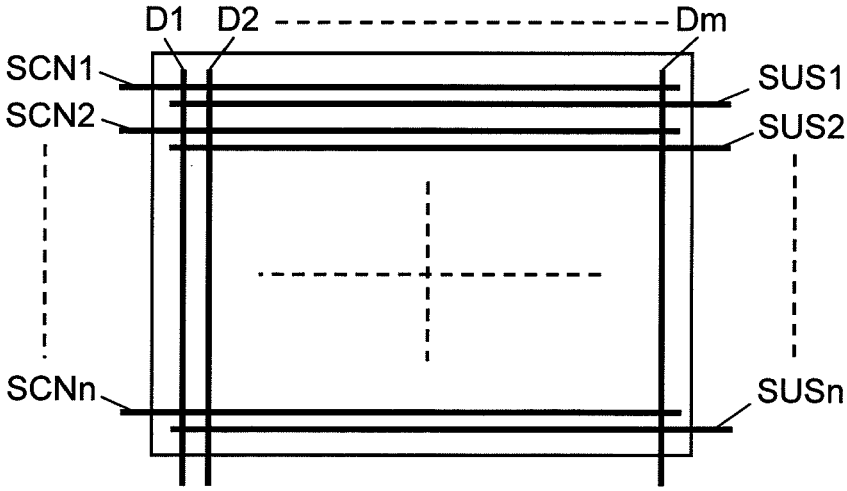
FIG. 2 is an electrode wiring diagram of the panel in accordance with the present invention.
Figure 3:
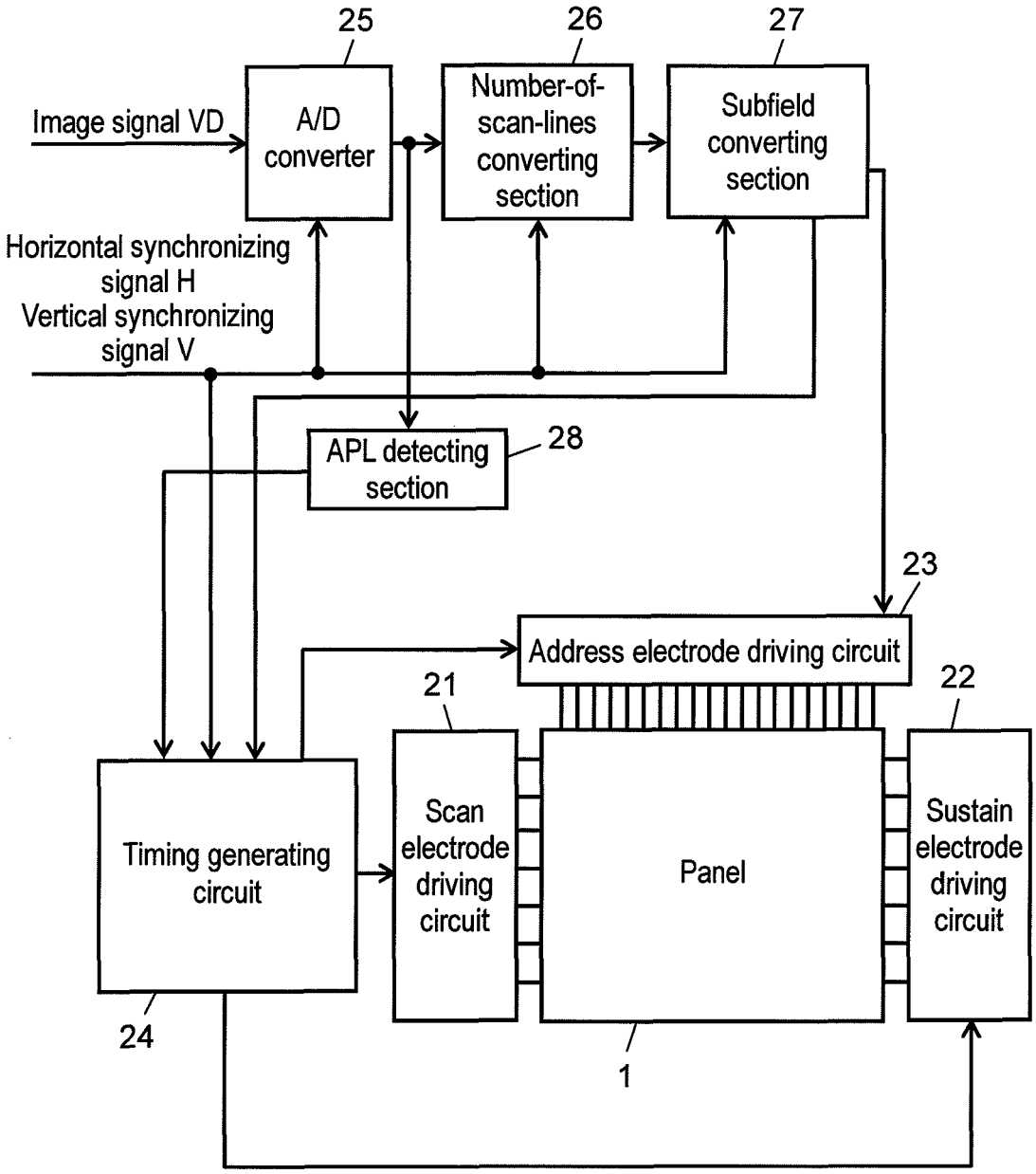
FIG. 3 is a block diagram of a plasma display device using the PDP of the present invention.

Next, an electrode arrangement of PDP 1 and a driving circuit are described. FIG. 2 shows the electrode arrangement of PDP 1. FIG. 3 is a block diagram showing the configuration of the driving circuit.

In FIG. 2, SCN1 through SCNn show first scan electrode 19*a* through n-th scan electrode 19*a*, SUS1 through SUSn show first sustain electrode 19*b* through n-th sustain electrode 19*b*, and D1 through Dm show first data electrode 14 through m-th data electrode 14.

As shown in FIG. 3, the plasma display device has plasma display panel 1, scan electrode driving circuit 21, sustain electrode driving circuit 22, address electrode driving circuit 23, timing generating circuit 24, analog/digital (A/D) converter 25, number-of-scan-lines converting section 26, subfield converting section 27, and average picture level (APL) detecting section 28.

In FIG. 3, image signal VD is input into analog/digital (A/D) converter 25. Horizontal synchronizing signal H and vertical synchronizing signal V are input into timing generating circuit 24, A/D converter 25, and number-of-scan-lines converting section 26. A/D converter 25 converts image signal VD into image data of a digital signal, and outputs the image data to number-of-scan-lines converting section 26 and APL detecting section 28. APL detecting section 28 detects the average luminance level of the image data, and controls the driving waveform forming one television field based on the average luminance level that is obtained by detecting the signal responsive to the detection result with timing generating circuit 24. Number-of-scan-lines converting section 26 converts the image data into image data corresponding to the number of pixels of plasma display panel 1, and outputs it to subfield converting section 27. The subfield is described later. Subfield converting section 27 outputs the image data divided into subfields to address electrode driving circuit 23. Address electrode driving circuit 23 applies voltage corresponding to each of address electrodes D1 through Dm to each address electrode in each subfield.

Timing generating circuit 24 generates a timing signal based on horizontal synchronizing signal H and vertical synchronizing signal V, and outputs it to scan electrode driving circuit 21 and sustain electrode driving circuit 22. Scan electrode driving circuit 21 applies driving voltage to scan electrodes SCN1 through SCNn based on the timing signal. Sustain electrode driving circuit 22 applies driving voltage to sustain electrodes SUS1 through SUSn based on the timing signal.

Figure 4:
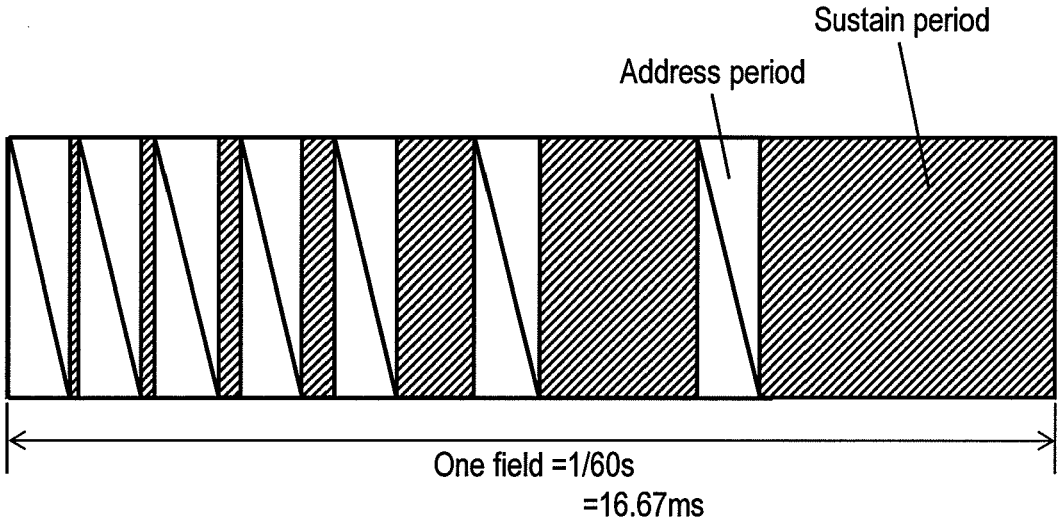
FIG. 4 is a block diagram of a subfield in a driving method of the PDP of the present invention.

Next, a gradation expression method used for PDP 1 is described. FIG. 4 shows the gradation expression method used for PDP 1. When television video is displayed, for example, the video of the national television standards committee (NTSC) method is formed of about 60 fields per second. Essentially, PDP 1 expresses only two gradations of lighting or un-lighting. Therefore, a method is used that time-divides the lighting time of each color of red, green, and blue by dividing one frame (or one field) into a plurality of subfields (hereinafter referred to as "SFs"), and expresses medium color by combination. The ratios of the number of sustain pulses applied in the discharge sustain periods of respective SFs are weighted in binary mode, such as "1", "2", "4", "8", "16", "32", "64", and "128", and 256 gradations are expressed by combination of 8 bits. In this method, in order to control gas discharge in discharge section 20, each SF is further divided into four periods.

Figure 5:
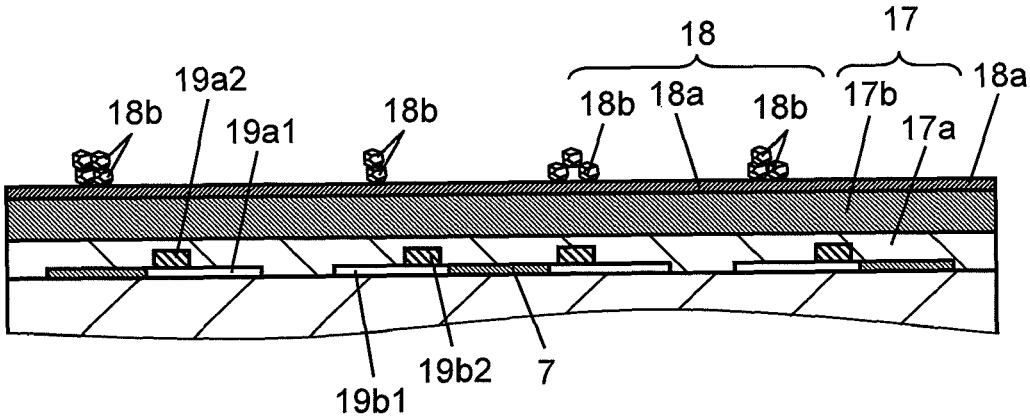
FIG. 5 is an enlarged view of a protective layer part of the PDP of the present invention.

Next, FIG. 5 shows a detail or the like of protective layer 18. As shown in FIG. 5, protective layer 18 protects dielectric layer 17 from ion collision, and improves the electron emission performance and charge retention performance that significantly affect the driving speed. For this purpose, protective layer 18 is formed of base protective layer 18*a* disposed on second dielectric layer 17*b* and crystal particles 18*b* of MgO disposed on base protective layer 18*a*.

Base protective layer 18*a* is an MgO crystal layer with a thickness of 0.3 to 1.0 μm that is formed by a spattering method, an ion plating method, or an electron beam deposition method. The layer of crystal particles 18*b* of MgO is formed by sticking, to base protective layer 18*a*, MgO single crystal particles that are produced by firing an MgO precursor and have relatively uniform diameter distribution with an average diameter of 0.3 to 4 μm. The MgO single crystal particles do not need to be formed so as to cover the whole surface of base protective layer 18*a*, but are required to be formed on base protective layer 18*a* in an island shape with a covering ratio of 1% to 30%. In other words, the area of crystal particles 18*b* facing discharge section 20 is smaller than the total area of the first substrate facing discharge section 20. Crystal particles 18*b* may be formed while MgO single crystal particles are partially buried in protective layer 18.

Figure 6:
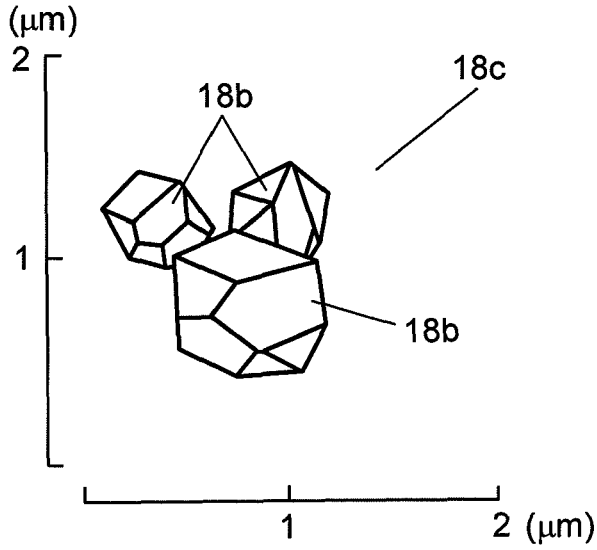
FIG. 6 is an enlarged view illustrating the shape of MgO single crystal in the protective layer of the PDP of the present invention.

FIG. 6 is a schematic view illustrating the shape of MgO single crystal particles included in crystal particles 18*b* of PDP 1 in accordance with the first exemplary embodiment of the present invention. The shapes of single crystal particles 18*b* are basically regular hexahedron or regular octahedron. Because of manufacturing variation, however, the shapes may have a truncated face and rhombic face provided by cutting a vertex and ridge line in the regular hexahedron or regular octahedron. Agglomerated particles 18*c* are in a state where crystal particles 18*b* are agglomerated or necked as shown in FIG. 6. In this state, the crystal particles are not bonded to each other like solid by a large bonding force, but a plurality of primary particles are bonded to each other into an aggregate by static electricity or Van der Waals force. The bonding is in the extent that a part or the whole of the aggregate is put into a primary particle state by external stimulus such as ultrasonic wave.

Figure 7:
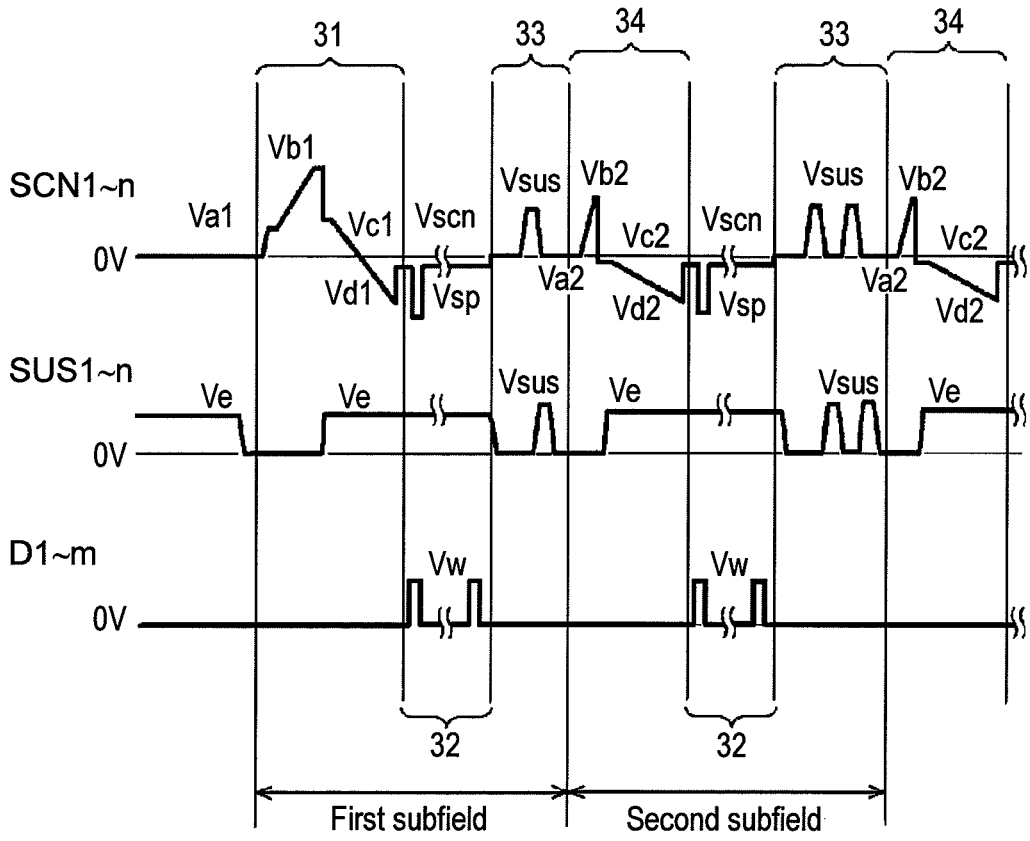
FIG. 7 is a timing chart of driving voltage applied to each electrode of the PDP in accordance with a first exemplary embodiment of the present invention.
Figure 12:
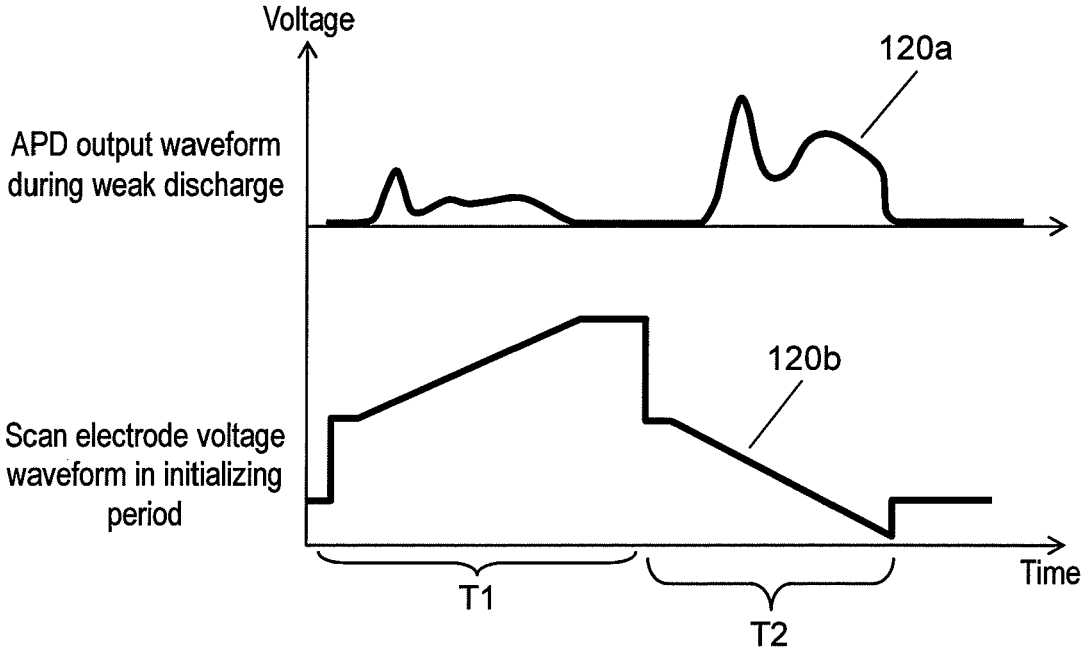
FIG. 12 is a diagram showing an avalanche photodiode (APD) output voltage in the case of weak discharge in an all-cell initializing period.

Next, the driving waveform and driving circuit in the initializing period in the PDP driving method of the first exemplary embodiment are described. As shown in FIG. 7, the PDP driving waveform of the first exemplary embodiment has first half T1 and latter half T2 in the initializing period of each SF. In first half T1 of the initializing period, voltage gradually increasing from first voltage Va1 to second voltage Vb1 is applied to scan electrode SCN1 through scan electrode SCNn. In latter half T2 of the initializing period, voltage gradually decreasing from third voltage Vc1 to fourth voltage Vd1 is applied to scan electrode SCN1 through scan electrode SCNn. FIG. 12 also shows this.

Figure 8:
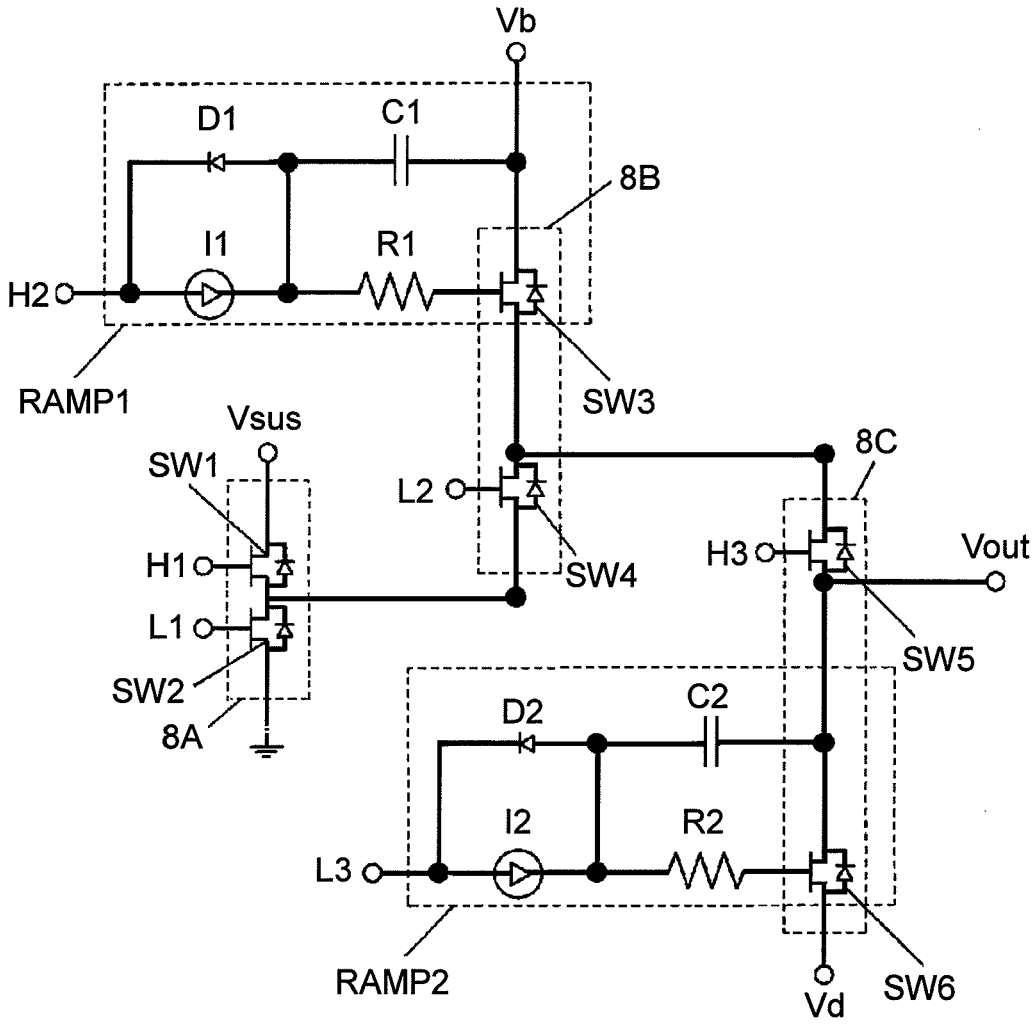
FIG. 8 is a diagram showing one example of a driving circuit configuration for outputting the driving waveform of the present invention.

FIG. 8 shows the configuration of a driving circuit for achieving the driving waveform of PDP 1 of the first exemplary embodiment. The driving circuit prepares power supply Vb for applying voltage gradually increasing in first half T1 of the initializing period, and controls the output of positive polarity voltage with a separating circuit. The driving circuit prepares power supply Vd for applying voltage gradually decreasing in latter half T2 of the initializing period, and controls the output of negative polarity voltage with a separating circuit. Separating circuit 8B for controlling the output of positive polarity voltage Vb is connected to the output terminal of separating circuit 8A for controlling the output of sustain voltage Vsus. Separating circuit 8C for controlling the output of negative polarity voltage Vd is connected to the output terminal of separating circuit 8B.

Ramp generating circuit RAMP1 that is formed of constant current circuit I1, capacitor C1, diode D1, resistor R1, and power supply voltage Vb is connected between a gate and a drain of a high-side switch of separating circuit 8B. Ramp generating circuit RAMP2 that is formed of constant current circuit I2, capacitor C2, diode D2, resistor R2, and power supply voltage Vd is connected between a gate and a drain of a low-side switch of separating circuit 8C. Thanks to this configuration of the driving circuit, gradually increasing voltage can be applied to the scan electrodes in first half T1 of the initializing period, and gradually decreasing voltage can be applied to the scan electrodes in latter half T2 of the initializing period. The circuitry shown in FIG. 8 is one example of outputting ramp voltage, and the present invention is not limited this.

Effect verifying experiments of the present invention are described hereinafter.

(Verifying Experiment 1)

Figure 9:
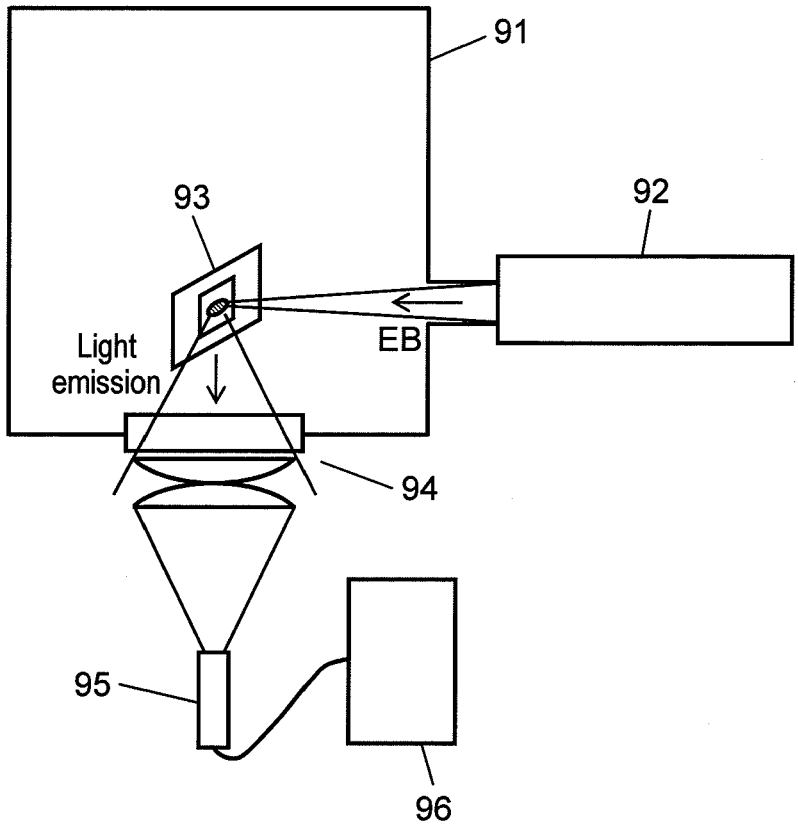
FIG. 9 is a schematic diagram of a CL emission spectrum analyzing device.

MgO single crystal particles are produced by each of a liquid phase method and a gas phase method, and cathode luminescence (CL) emission of the single crystal particles is investigated. For CL emission spectrum analysis, a spectrophotometric system of high sensitivity type is employed. FIG. 9 is a schematic diagram of an emission spectrum analyzing device. In vacuum chamber 91, an electron beam (EB) where the incident energy is 3 keV and the beam current is 3.9 μA is radiated from electron gun 92 to sample 93 at an incident angle of 45°. The obtained light is made to come into high-sensitivity spectrophotometric system 95 for emission spectrum analysis (here, Otsuka Electronics CO., LTD. IMUC7500 is used) via optical system 94 such as a lens or fiber, and dispersed by spectroscope 96, thereby measuring the CL emission spectrum. In the spectrophotometric system, calibration for correcting the sensitivity of spectroscope 96 to each wavelength is performed.

Figure 10:
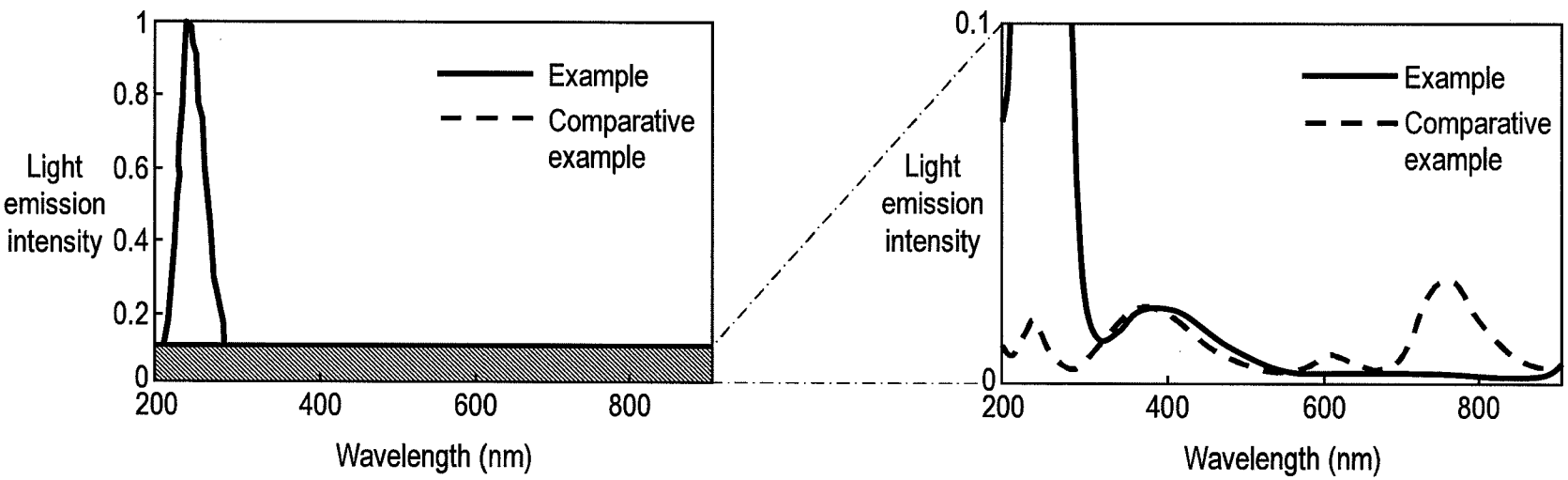
FIG. 10 is a diagram showing a CL emission spectrum measurement result of the MgO single crystal particles.

FIG. 10 shows CL emission spectra of crystal particles 18*b* in a PDP of the present invention employing single crystal produced by the liquid phase method and in a conventional PDP (conventional example 3) employing single crystal produced by the gas phase method. In FIG. 10, the horizontal axis shows wavelength, and the vertical axis shows emission intensity. The solid line shows the characteristic of the first exemplary embodiment, and the broken line shows the characteristic of conventional example 3. The CL emission spectrum of crystal particles 18*b* of the first exemplary embodiment has a high peak at a wavelength of 200 to 300 nm, and a low peak at 300 to 550 nm. While, the emission spectrum of single crystal particles of conventional example 3 produced by a gas phase oxidation method has a low peak at a wavelength of 200 to 300 nm, and a low peak at 300 to 550 nm.

The relation between the discharge delay time and the electron emission performance is described. The electron emission performance depends on the number of electrons (current density) per unit area and unit time emitted from the surface of protective layer 18 that includes base protective layer 18*a* and agglomerated particles 18*c*. In a considered method of measuring the current density flowing from the surface of protective layer 18 to the discharge section, a prototype is broken, a chip sample of the front plate is put into the vacuum chamber, and an electron emitted from the external electric field to space is captured and detected by a photomultiplier or the like. However, the current density from protective layer 18 is difficult to be measured when the PDP is actually driven.

As disclosed in Unexamined Japanese Patent Publication No. 2007-48733, discharge statistical delay time Ts is used as measuring amount correlated with the current density until discharge. The temporal discharge delay since voltage is applied until the discharge has a peak is interpreted as the sum of discharge formative delay time Tf and discharge statistical delay time Ts. The discharge delay time depends on the applied voltage and on the electron density in the gas before the discharge start. Discharge formative delay time Tf is correlated with the applied voltage, and discharge statistical delay time Ts is correlated with the electron density in the gas before the discharge start. Statistical delay time Ts at each time is measured as a function of the time until the discharge start. The inverse number of statistical delay time Ts is proportional to the current density of the electrons coming from the protective layer surrounding the discharge gas. When the inverse number of statistical delay time Ts is considered to be a function of the time until the discharge start and is integrated with respect to time, the relative comparison of electron emission amount per unit area from protective layer 18 is allowed.

Figure 11:
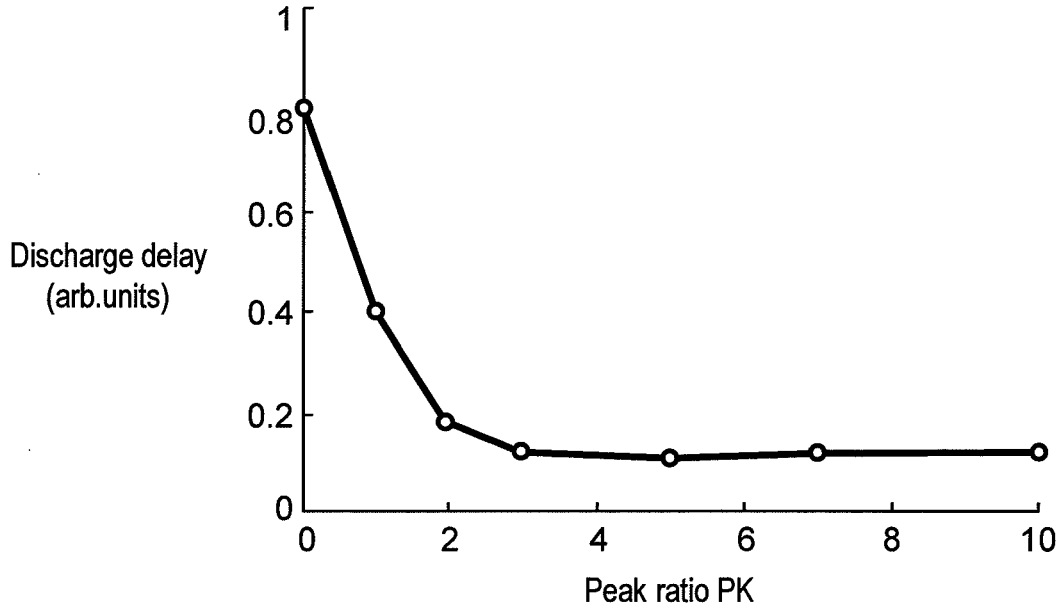
FIG. 11 is a diagram showing the relation between the ratio of a peak integrated value of the CL emission spectrum and the discharge delay time.

The inventors focus attention on the ratio of the peak at a wavelength of 200 to 300 nm to that at 300 to 550 nm, and investigate the correlation between the peak ratio and the discharge delay time in the address operation. Samples of different emission peak ratios of the CL emission spectrum are prototyped, and the discharge delay times (relative ratios) are compared with each other. FIG. 11 shows the result thereof. In FIG. 11, the horizontal axis shows peak ratio PK, and vertical axis shows the discharge delay. Peak ratio PK is determined by dividing the integrated value Sa of the emission spectrum at a wavelength of 200 nm or higher and lower than 300 nm by the integrated value Sb of the emission spectrum at a wavelength of 300 nm or higher and lower than 550 nm. The discharge delay time of FIG. 11 is a relative ratio to the discharge delay time of conventional example 3, namely the reference, where a strong peak does not appear at a wavelength of 200 nm or higher and lower than 300 nm. When peak ratio PK of the CL emission spectrum is "2" or higher, it becomes clear that the discharge delay time is a substantially constant value of "0.2" or smaller, the electron emission performance is high, and the discharge delay time is shortened.

The correlation between the peak ratio PK of the CL emission spectrum and the electron emission performance is not physically clarified, but the following can be estimated.

The peak at a wavelength of 200 to 300 nm in the emission spectrum indicates that a process of reducing energy by about 5 eV exists, and it is predicted that the probability of Auger electron emission accompanying significant energy reduction is high. While, the peak at a wavelength of 300 to 550 nm in the emission spectrum indicates that many trap levels caused by an oxygen defect or the like exist between band gaps, and it is predicted that the significant energy reducing process hardly occurs and the probability of Auger electron emission is also low. Therefore, it is considered that, when the peak at a wavelength of 200 to 300 nm is higher and the peak at 300 to 550 nm is lower, the electron emission performance is higher. Forming crystal particles 18*b* using single crystal particles having high electron emission performance allows a PDP of high electron emission performance to be obtained.

The MgO single crystal particles having a high peak at a wavelength of 200 to 300 nm and a low peak at 300 to 550 nm in the emission spectrum are produced by the liquid phase method. Specifically, as described below, the single crystal particles can be produced by uniformly firing magnesium hydroxide as an MgO precursor in a high-temperature oxygen-containing atmosphere.

(Liquid phase method 1) In liquid phase method 1, aqueous solution of magnesium alkoxide or magnesium acetylacetone of a purity of 99.95% or higher is hydrolyzed by adding a small amount of acid to it, and gel of magnesium hydroxide is produced. Then, the gel is fired in the air to be dehydrated, thereby producing powder of the single crystal particles.

(Liquid phase method 2) In liquid phase method 2, alkaline solution is added to aqueous solution of magnesium nitrate of a purity of 99.95% or higher to precipitate magnesium hydroxide. Then, the precipitate of magnesium hydroxide is separated from the aqueous solution, and is fired in the air to be dehydrated, thereby producing powder of the single crystal particles.

(Liquid phase method 3) In liquid phase method 3, calcium hydroxide is added to aqueous solution of magnesium chloride of a purity of 99.95% or higher to precipitate magnesium hydroxide. Then, the precipitate of magnesium hydroxide is separated from the aqueous solution, and is fired in the air to be dehydrated, thereby producing powder of the single crystal particles.

The firing temperature is preferably 700° C. or higher, more preferably 1000° C. or higher. This is because it is predicted that crystal faces do not sufficiently develop and hence defects increase in number at a temperature lower than 700° C. According to the experiment by the inventors, firing at temperature of 700° C. or higher and lower than 2000° C. allows production of the following two types of single crystal particles:

- single crystal particles having a peak ratio PK of "1" or higher in a wavelength range of 200 to 300 nm; and
- single crystal particles that have a peak ratio PK lower than "1" in a wavelength range of 200 to 300 nm and a high peak in a wavelength range of 680 to 900 nm.

When the firing temperature is 1400° C. or higher, the producing percentage of the single crystal particles that have a peak ratio PK lower than "1" in a wavelength range of 200 to 300 nm and a high peak in a wavelength range of 680 to 900 nm increases. Therefore, in order to increase the producing percentage of MgO single crystal particles having a peak ratio PK of "1" or higher in a wavelength range of 200 to 300 nm, the firing temperature is preferably set at 700° C. or higher and lower than 1400° C.

As the MgO precursor, in addition to the above-mentioned magnesium hydroxide, one or more of magnesium alkoxide, magnesium acetylacetone, magnesium nitrate, magnesium chloride, magnesium carbonate, magnesium sulfate, magnesium oxalate, and magnesium acetate can be used. The purity of the magnesium compound as the MgO precursor is preferably 99.95% or higher, more preferably 99.98% or higher. When many impurity elements such as alkali metal, boron, silicon, iron, and aluminum are contained, fusion or sintering between particles occur during firing, and particles of high crystallinity hardly grow.

The MgO single crystal that has a peak ratio PK lower than "1" in a wavelength range of 200 to 300 nm and a high peak in 680 to 900 nm has a particle diameter smaller than that of MgO single crystal having a peak ratio PK of "1" or higher in a wavelength range of 200 to 300 nm. Therefore, these two types of MgO single crystals can be separated from each other by classification, and single crystal particles having a high peak ratio PK in a wavelength range of 200 to 300 nm can be selected.

Thus, crystal particles 18*b* of the first embodiment are formed by substantially uniformly and discretely sticking, to the whole surface of base protective layer 18*a*, single crystal particles where the ratio of the emission peak at a wavelength of 200 to 300 nm to that at 300 to 550 nm is "2" or higher. In other words, the MgO single crystal particles have a ratio c/d of 2 or higher, where Sc is the spectrum maximum value in a wavelength region of 200 nm or higher and lower than 300 nm in the cathode luminescence, and Sd is the spectrum maximum value in a wavelength region of 300 nm or higher and lower than 550 nm in the cathode luminescence. Thus, the PDP that has stably high electron emission performance and can be driven at high speed can be provided.

(Verifying Experiment 2)

Prototype 1 and prototype 2 are prepared. Prototype 1 has only a base protective layer made of MgO doped with an impurity such as Al or Si. In prototype 2, single crystal particles are stuck to a base protective layer made of MgO so that the particles are distributed on the whole surface. Since prototype 1 has no single crystal particle, the CL emission spectrum has a spectrum characteristic similar to that of conventional example 3 where a high peak does not appear at a wavelength of 200 nm or higher and lower than 300 nm, and the discharge delay time (relative ratio) is about 1.

Easinesses to occur of strong discharge of these prototypes in the all-cell initializing period are compared with each other, and the suppressing effect of strong discharge in the all-cell initializing period in prototype 2 of the present invention is verified.

In this experiment, as a measuring apparatus, a photodiode (hereinafter referred to as "APD") for near infrared radiation used as a receiving section of a light signal is employed. The magnitude of the discharge in the all-cell initializing period is observed based on an output of the APD. The magnitude of the discharge can be identified based on the generation amount of near infrared radiation radiated from transition between excited states of xenon. When the discharge is strong, the generation amount of near infrared radiation increases.

Figure 13:
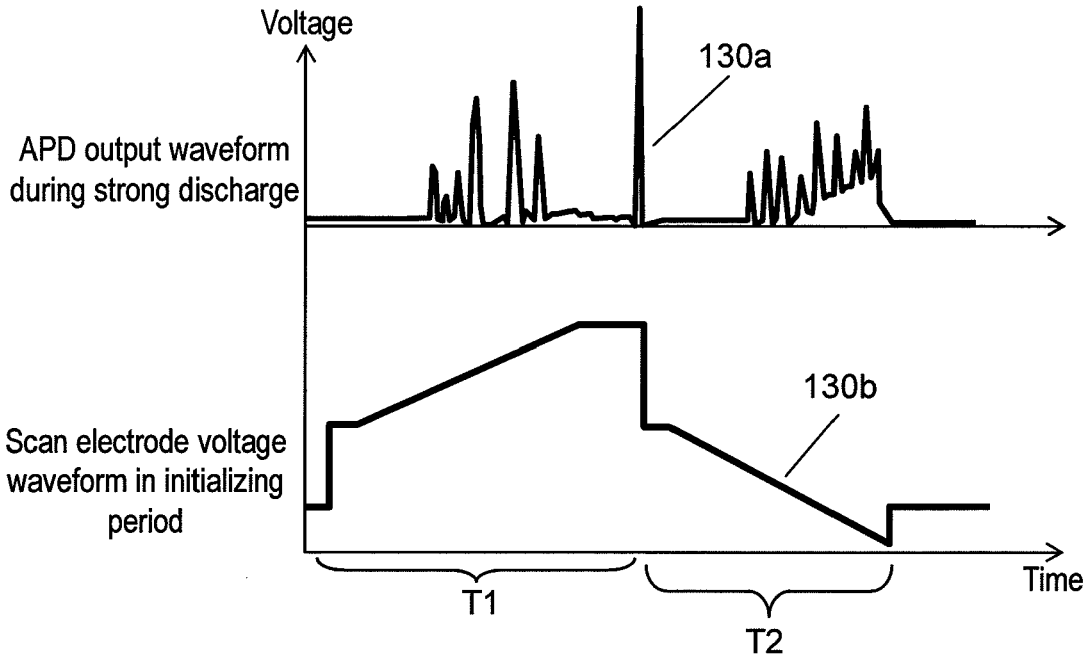
FIG. 13 is a diagram showing an APD output voltage in the case of strong discharge in the all-cell initializing period.

For example, FIG. 12 is a schematic diagram of an APD output waveform during occurrence of weak discharge in the all-cell initializing period, and FIG. 13 is a schematic diagram of an APD output waveform during occurrence of strong discharge in the all-cell initializing period.

FIG. 12 shows APD output waveform 120*a* during occurrence of weak discharge and scan electrode voltage waveform 120*b* in the initializing period. In FIG. 12, the horizontal axis shows time, and the vertical axis shows voltage. In FIG. 12, in first half T1 of the initializing period, positive voltage is applied to scan electrodes, and the potential difference including wall potential inside or on the discharge section around the electrodes is higher than the potential difference of discharge start. Here, not temporally sharp ionization multiplication but gradually developing weak discharge occurs stably. In latter half T2 of the initializing period when the voltage applied to the scan electrodes is switched from positive voltage to negative voltage, redundant wall charge is removed from wall charge accumulated in first half T1 of the initializing period, and the wall charge is adjusted. Weak discharge in first half T1 and latter half T2 of the initializing period allows wall charge desired for address discharge to be accumulated on the discharge sections around the scan electrodes and address electrodes.

FIG. 13 shows APD output waveform 130*a* during occurrence of strong discharge and scan electrode voltage waveform 130*b* in the initializing period. In FIG. 13, the horizontal axis shows time, and the vertical axis shows voltage. In FIG. 13, in first half T1 of the initializing period, positive voltage is applied to scan electrodes, and the potential difference including wall potential inside or on the discharge section around the electrodes is higher than the potential difference of discharge start. Here, temporally sharp ionization multiplication develops and strong discharge occurs. In latter half T2 of the initializing period when the voltage applied to the scan electrodes is switched from positive voltage to negative voltage, excessive wall charge accumulated in first half T1 of the initializing period causes strong discharge also when the voltage of the scan electrodes falls from a peak voltage.

Thus, the panel temperatures of prototype 1 and prototype 2 are varied while whether strong discharge occurs in the all-cell initializing period is monitored with the APD, and the critical gradient of the ramp voltage for causing strong discharge in the first half of the initializing period is measured. As constant current circuit I1 of ramp voltage generating circuit RAMP1, circuitry of a combination of a p-type semiconductor, a metal oxide semiconductor field effect transistor (MOSFET), and a volume resistor is used, and performs control. In a cell where strong discharge occurs, light emission is stronger than in another cell where weak discharge occurs and the occurrence of the strong discharge can be recognized even visually. The strong discharge is monitored by both the APD and visual observation.

Figure 14:
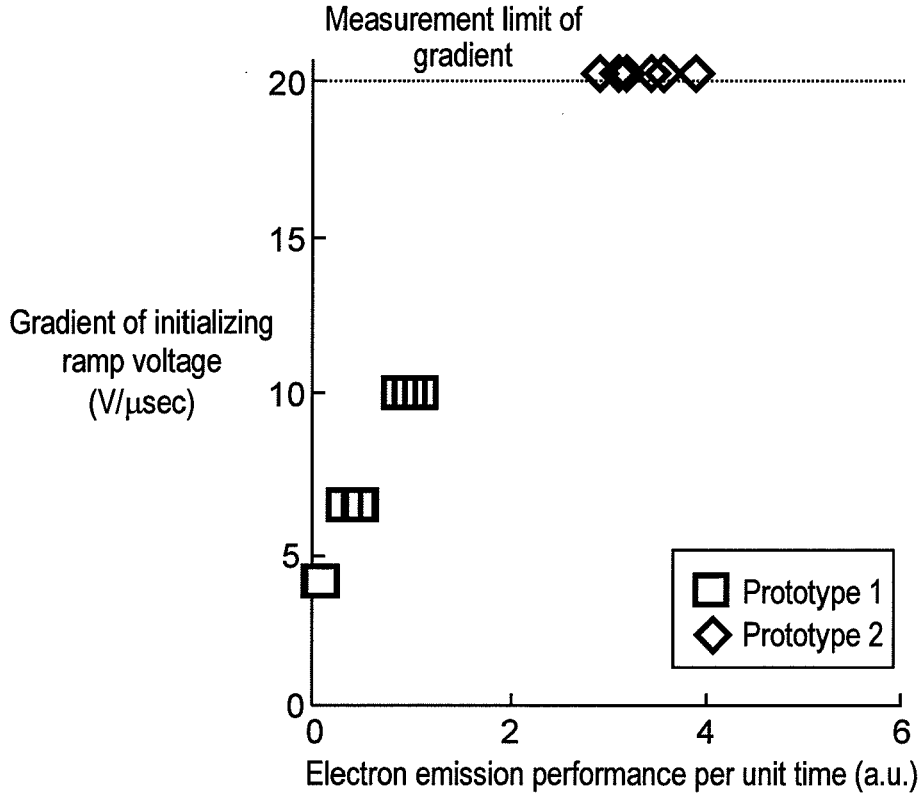
FIG. 14 is a characteristic diagram showing the relation between the electron emission performance and the critical gradient of the initializing ramp voltage, in an experiment for verifying the effect of the plasma display device of the present invention.

The electron emission performance at each panel temperature is known by a previous experiment described later, and the relation between the electron emission performance and the critical gradient is clarified by the present experiment. FIG. 14 shows the result.

In FIG. 14, the horizontal axis shows electron emission performance (a.u.) per unit time, and the vertical axis shows initializing ramp voltage gradient (V/μsec). When the panel temperature is low, the electron emission performance of prototype 1 extremely degrades, and the gradient of the ramp voltage must be made gentler. While, in prototype 2, regardless of the panel temperature, strong discharge does not occur even when the gradient of the ramp voltage is set at 20 V/μsec, namely the measuring limit of the evaluating device. In the plot of FIG. 14, the critical gradient of prototype 2 is set at 20 V/μsec.

In prototype 1 having no crystal particle 18*b*, in order to prevent strong discharge in the all-cell initializing period, the gradient of the ramp voltage must be made gentler and the initializing period must be extended. Therefore, a means for shortening the sustain period and address period is considered.

However, the shortening of the sustain period presents a serious problem when the definition is improved. In a high-definition PDP, the cell pitch decreases, the percentage occupied by metal electrodes and barrier ribs in a pixel increases, the numerical aperture decreases, and the luminance decreases. When the initializing period is extended and the sustain period is shortened in order to prevent the strong discharge, the number of maximum sustain pulses decreases and the peak luminance reduces. Synergizing of them extremely degrades bright part contrast and the image quality in the high-definition PDP.

Figure 15:
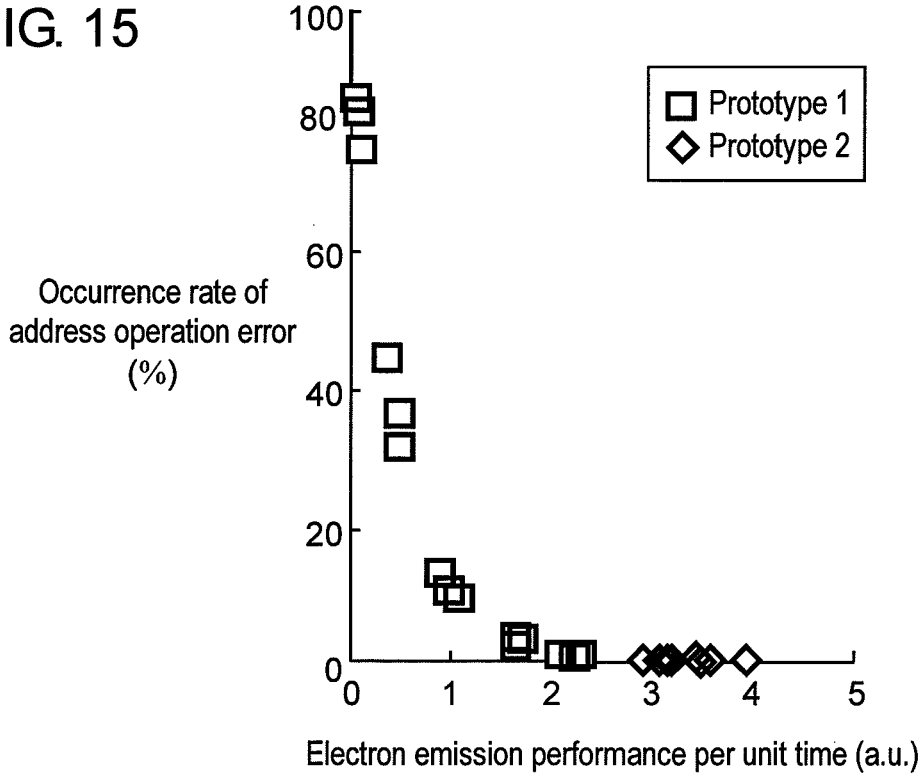
FIG. 15 is a characteristic diagram showing the relation between the electron emission performance and the gradient of the address operation error occurrence rate, in the experiment for verifying the effect of the plasma display device of the present invention.

When the address period is shortened, the cycle of the scan voltage is shorter than the discharge delay time, and the address operation cannot be normally performed. FIG. 15 shows the relation between the electron emission performance per unit time and address operation error occurrence rate while the cycle of the scan voltage is set at 1.2 μsec, for example. In FIG. 15, the horizontal axis shows electron emission performance (a.u.) per unit time, and the vertical axis shows address operation error occurrence rate (%). When the panel temperature becomes low, in prototype 1, electron emission performance degrades, the discharge delay time elongates, and the address operation cannot be performed normally. While, in prototype 2, no address operation error occurs, and stable address operation can be performed.

Figure 16:
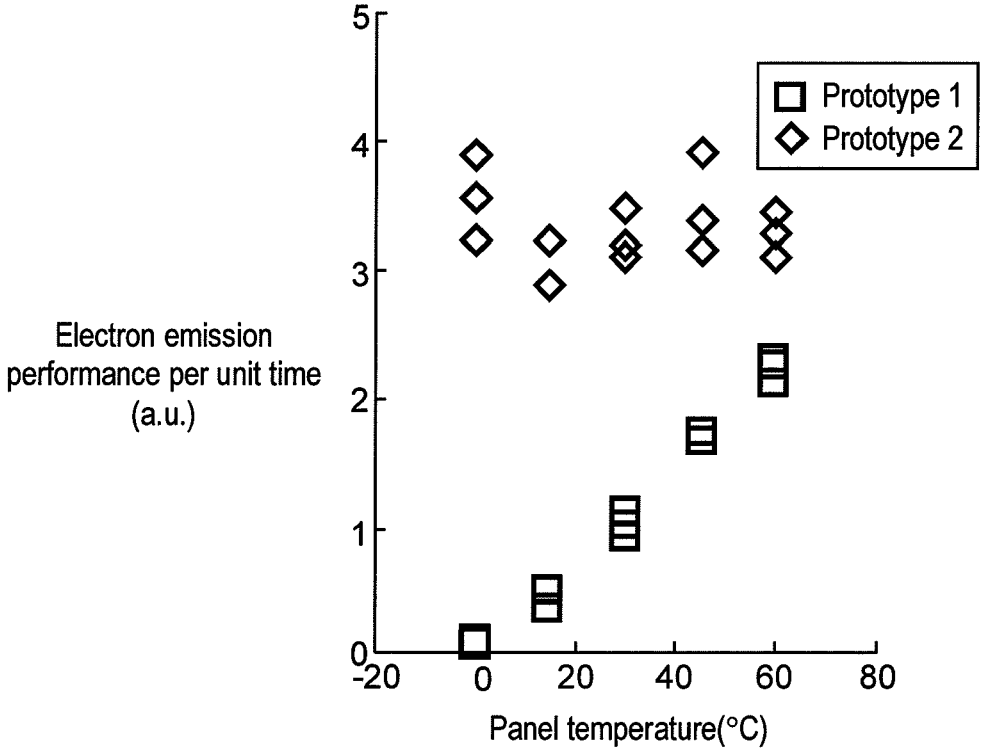
FIG. 16 is a characteristic diagram showing the relation between the panel temperature and the electron emission performance, in the experiment for verifying the effect of the plasma display device of the present invention.

Thus, in prototype 1 having no crystal particle 18*b*, the prevention of strong discharge in the initializing period and the temporal restriction to the sustain period and address period cannot be compatibly performed. Here, the previous experiment is described. In the previous experiment, the relation between the panel temperature and the relative value of the electron emission performance calculated from the inverse number of statistical delay time Ts is investigated. FIG. 16 shows the result. In FIG. 16, the horizontal axis shows the panel temperature (° C.), and the vertical axis shows electron emission performance (a.u.) per unit time. Here, regarding the electron emission performance, the electron emission performance of prototype 1 at a panel temperature of 30° C. is assumed to be 1, the relative value at another panel temperature and the relative value of the electron emission performance of prototype 2 are calculated. According to FIG. 16, in prototype 1, the electron emission performance per unit time rapidly degrades with decrease in panel temperature. In prototype 2, high electron emission performance is kept stably regardless of the panel temperature.

Next, charge retention performance is described. As the index of the charge retention performance, voltage Vscn applied in the address period is used. The voltage Vscn of reversed polarity to the wall potential is applied to the scan electrodes so that the wall charge desired for the address operation is not lost since the completion of the initializing operation before the start of the address period. Thus, the loss of the wall charge in the waiting period of address operation is suppressed.

When at least any one of surface current on the protective film and the charge exchange between the protective film and discharge gas is apt to cause loss of accumulated wall charge, voltage Vscn is apt to increase. Lower voltage Vscn indicates higher charge retention performance. In the present products, as a semiconductor switching element such as a MOSFET for sequentially applying scan voltage to the panel, an element of a breakdown voltage of about 150 V is employed. Therefore, preferably, voltage Vscn is suppressed at 120 V or lower in consideration of the damage due to the heat generation of the switching element. In the PDP of the present invention, measurement of minimum scan voltage Vscn required for the address operation indicates the characteristic of 120 V or lower.

(Verifying Experiment 3)

Figure 17:
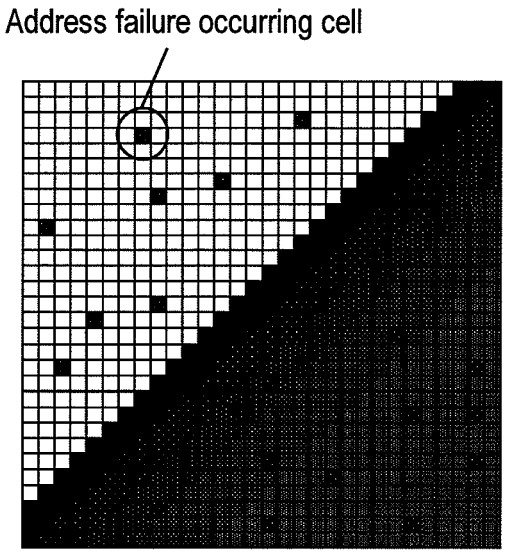
FIG. 17 is a diagram showing the display state when driving waveform 1 related to a conventional example is applied, in the experiment for verifying the effect of the plasma display device of the present invention.
Figure 18:
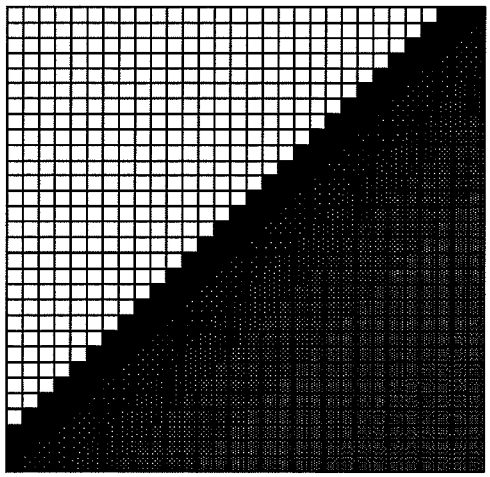
FIG. 18 is a diagram showing the display state when driving waveform 2 related to the present invention is applied, in the experiment for verifying the effect of the plasma display device of the present invention.

Driving waveform 1 of the conventional driving method and driving waveform 2 of the present invention are applied to prototype 2 related to the present invention, and lighting failures due to discharge interference between adjacent cells are compared with each other. As driving waveform 1 of the conventional driving method, erasing voltage with a rectangular waveform of a rising gradient of 37 V/μsec is applied in the selective initializing period. As driving waveform 2, ramp voltage gradually increasing at 10 V/μsec is applied in the first half of the selective initializing period. FIG. 17 shows the state of driving waveform 1, and FIG. 18 shows the state of driving waveform 2.

As shown in FIG. 17, in driving method 1 where the rectangular waveform is applied in the selective initializing period, many cells (address failure occurring cells) undergoing a lighting failure are observed. As shown in FIG. 18, in driving waveform 2, namely when the ramp voltage gradually increasing is applied in the selective initializing period, a cell undergoing a lighting failure is not observed. In driving waveform 1, strong discharge occurs in the selective initializing period, and the discharge interference between adjacent cells is large. In driving waveform 2, weak discharge occurs in the selective initializing period, and the discharge interference between adjacent cells is small. The magnitude of the discharge in the selective initializing period in each driving waveform is recognized by an APD.

Regarding prototype 2, variation or the like in thickness of the dielectric layer in the panel surface varies the degree of the discharge interference, and the gradient of the ramp voltage causing damage of video display in the first half of the selective initializing period is investigated. As a result, both the critical gradients of up-ramp and down-ramp voltages are 25 to 35 V/μsec.

The present invention allows a high-definition, high-quality and inexpensive plasma display device where occurrence of strong discharge is suppressed in the initializing period regardless of all-cell or selective initializing period and stable address operation is allowed at a voltage Vscn of 120 V or lower.

(Second Exemplary Embodiment)

Figure 19:
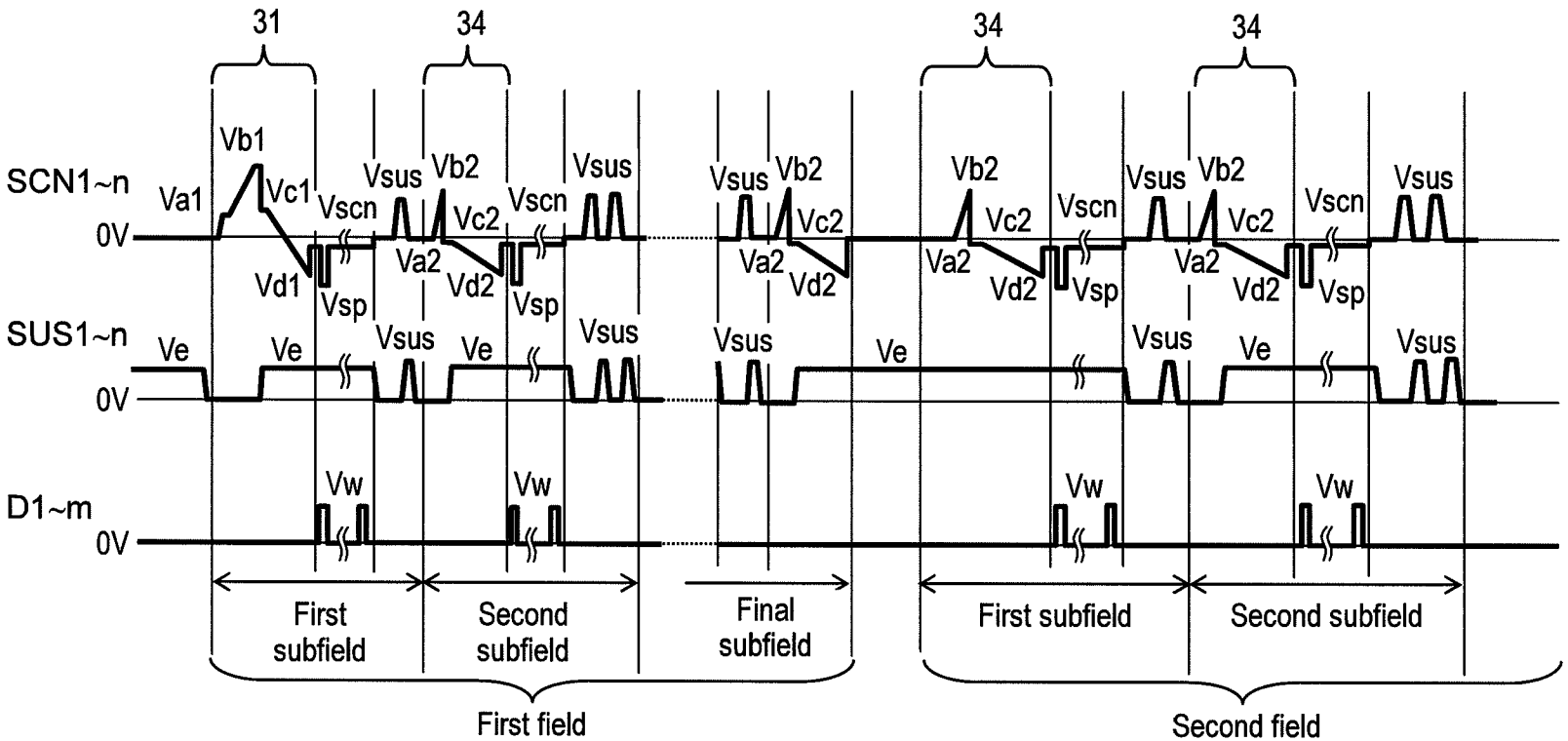
FIG. 19 is a timing chart of driving voltage applied to each electrode in accordance with a second exemplary embodiment of the present invention.

In a driving method of a second exemplary embodiment of the present invention, of the fields related to image discharge, there is at least one field where all the initializing operations performed in the initializing periods of respective SFs are selective initializing operation. FIG. 19 shows applied driving waveforms. Verification of the effect of the second exemplary embodiment is described hereinafter. In this verification, PDPs of prototype 1 and prototype 2 are employed.

Figure 20:
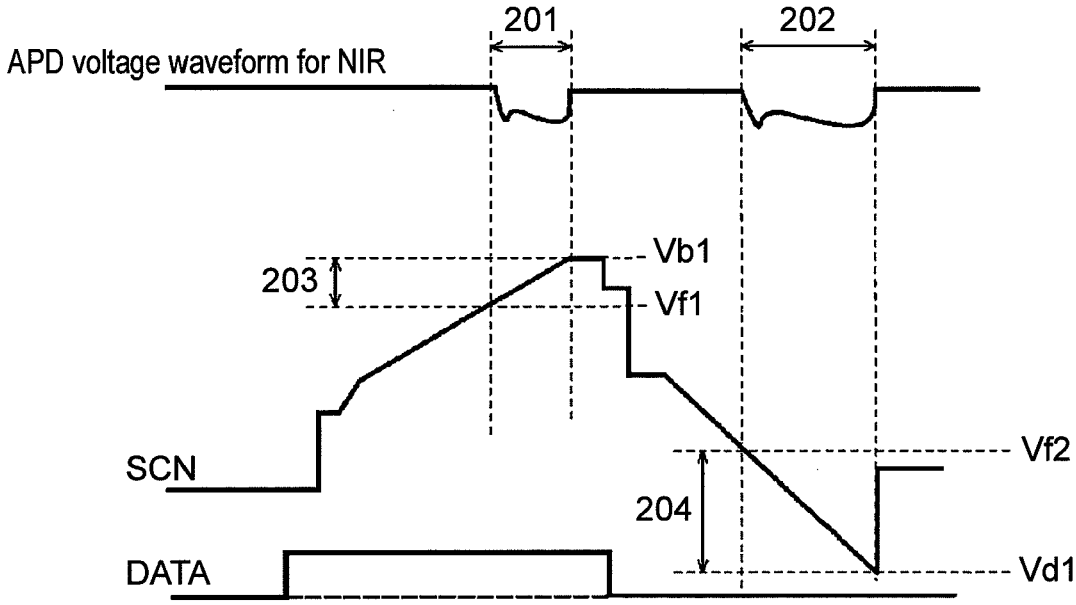
FIG. 20 is a diagram illustrating an initializing pop voltage.

First, second voltage Vb1 in the all-cell initializing period is varied using the driving waveform of FIG. 7 of the present invention, and the luminance during black display is measured. At this time, the sum of the voltages related to the discharges in first half T1 of the initializing period and in latter half T2 of the initializing period is measured as initializing pop voltage. Specifically, in first half T1 of the initializing period, the voltage that is between first voltage Val and second voltage Vb1 and at which discharge starts is set at Vf1. In latter half T2 of the initializing period, the voltage that is between third voltage Vc1 and fourth voltage Vd1 and at which discharge starts is set at Vf1. At this time, the initializing pop voltage is represented by (Vb1−Vf1)+(Vf2−Vd1). FIG. 20 is a schematic diagram related to the measurement of the initializing pop voltage.

In FIG. 20, the horizontal axis shows time. FIG. 20 shows a photodiode voltage waveform for near infrared radiation (NIR) (APD voltage waveform for NIR in FIG. 20), a driving waveform (SCN in FIG. 20) of the scan electrodes, and a driving waveform (DATA in FIG. 20) of the data electrodes. The voltage from voltage Vf1 to voltage Vb1 is rising pop voltage 203, and the voltage from voltage Vd1 to voltage Vf1 is falling pop voltage 204. Rising light emission 201 occurs in the period when the driving voltage of the scan electrodes is rising pop voltage 203, and falling light emission 202 occurs in the period when the driving voltage of the scan electrodes is falling pop voltage 204.

Figure 21:
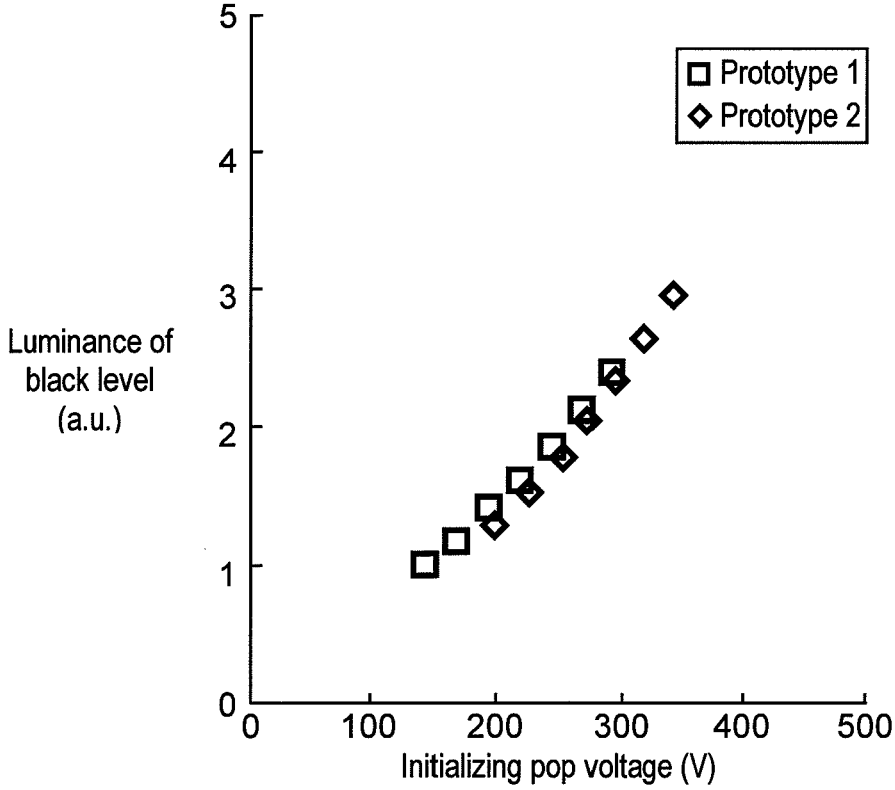
FIG. 21 is a characteristic diagram showing the relation between the initializing pop voltage and luminance of black level, in the experiment for verifying the effect of the plasma display device of the present invention.
Figure 22A:
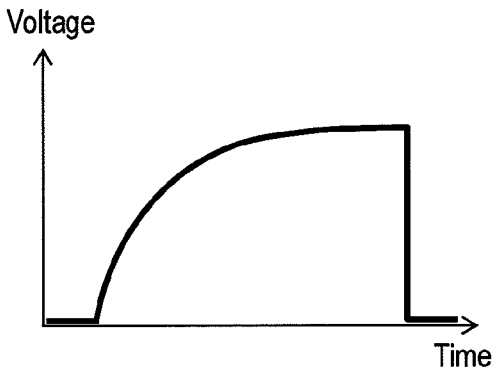
FIG. 22A is a diagram showing one example of the driving waveform applied to a scan electrode in the first half of the initializing period in accordance with a third exemplary embodiment of the present invention.
Figure 22B:
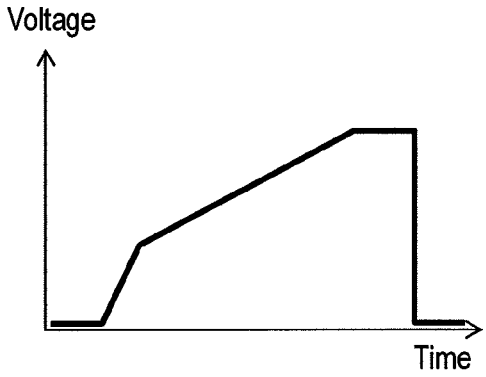
FIG. 22B is a diagram showing another example of the driving waveform applied to the scan electrode in the first half of the initializing period in accordance with the third exemplary embodiment of the present invention.
Figure 22C:
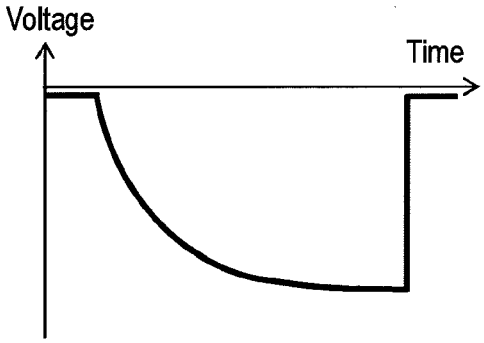
FIG. 22C is a diagram showing yet another example of the driving waveform applied to the scan electrode in the latter half of the initializing period in accordance with the third exemplary embodiment of the present invention.
Figure 22D:
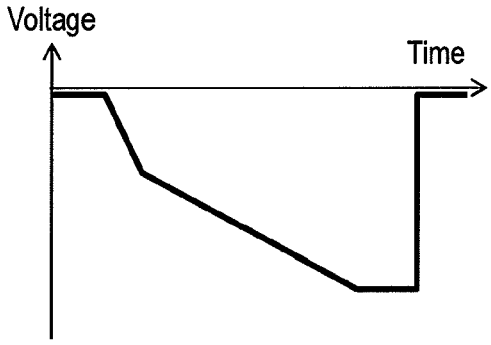
FIG. 22D is a diagram showing still another example of the driving waveform applied to the scan electrode in the latter half of the initializing period in accordance with the third exemplary embodiment of the present invention.

Next, in FIG. 21, the horizontal axis shows the initializing pop voltage and the vertical axis shows the luminance during black display (hereinafter referred to as "luminance of black level", also in FIG. 21). Here, both the gradients of the ramp voltages in first half T1 and latter half T2 of the initializing period are set at 2 V/μsec, third voltage Vc1 is set at 210 V, and fourth voltage is set at 132 V. According to the study of the present inventors, the relation between the voltage (initializing pop voltage) related to weak discharge and the light emission amount due to the weak discharge depends on the discharge gas more remarkably than on the composition of the protective layer when the cell structure such as electron distance or cell pitch is the same. Prototype 1 and prototype 2 provide the same tendency characteristic of luminance of black level because they have the same cell structure, the same discharge gas, and simply different protective layer structures.

In the PDP of the present invention and the driving method of FIG. 7, when address operation is performed in a certain cell in the precedent field of a certain field, the initializing pop voltage in the all-cell initializing operation in the certain field is larger than the initializing pop voltage in the selective initializing operation by up to (Vb1−Vb2). In the cell having undergone address operation in the precedent SF of the certain SF, more wall charge is accumulated than in the cell having undergone no address operation, and the initializing operation (here, selective initializing operation) can be performed at second voltage Vb2 lower than second voltage Vb1 applied in the all-cell initializing operation.

When the charge retention performance is low, however, the accumulated wall charge is gradually lost in the pause period since the address operation is performed until the selective initializing operation is performed, and the selective initializing operation cannot be performed normally. For example, when the panel temperature is increased by continuous display in prototype 1, the charge retention performance degrades, and minimum scan voltage Vscn required for address operation rapidly increases to significantly exceed a reference value of 120 V.

In prototype 2, minimum scan voltage Vscn does not increase regardless the panel temperature and is lower than the reference value of 120 V. When the driving method of FIG. 19 is applied to prototype 1, wall charge shortage does not allow the selective initializing operation in some cells, and image display cannot be performed normally. When the driving method of the present invention in FIG. 19 is applied to PDP prototype 2 related to the present invention, strong discharge in the initializing operation is suppressed, and selective address operation can be performed.

Therefore, in the PDP of low charge retention performance related to the conventional example, in order to accumulate wall charge desired for the address operation in the initializing operation, at least one all-cell initializing operation of high peak value is required in each field. In the PDP related to the present invention, the charge retention performance is stably high regardless of the panel temperature, so that the all-cell initializing operation does not need to be performed in each field.

In the PDP of the present invention and the driving method of FIG. 7, in the cell having undergone address operation as described above, surplus voltage of up to (Vb1−Vb2) is applied in the all-cell initializing operation. For example, in the driving method of FIG. 7 set as Vb1−Vb2=100 V, the luminance of black level increases by up to 89% when the all-cell initializing operation is applied to the cell having undergone the address operation.

In the PDP of high charge retention performance related to the present invention, as shown in FIG. 19, reduction of the number of all-cell initializing operations can make the luminance of black level lower than that of FIG. 7, and a plasma display device of high black expressiveness can be provided.

(Third Exemplary Embodiment)

A driving method of yet another exemplary embodiment of the present invention is described. FIG. 22A through FIG. 22D show a driving method of a third exemplary embodiment. In FIG. 22A through FIG. 22D, the horizontal axis shows time, and the vertical axis shows voltage. In the third exemplary embodiment, as shown in FIG. 22A through FIG. 22D, the gradient of the ramp voltage varies at a midway.

Figure 23:
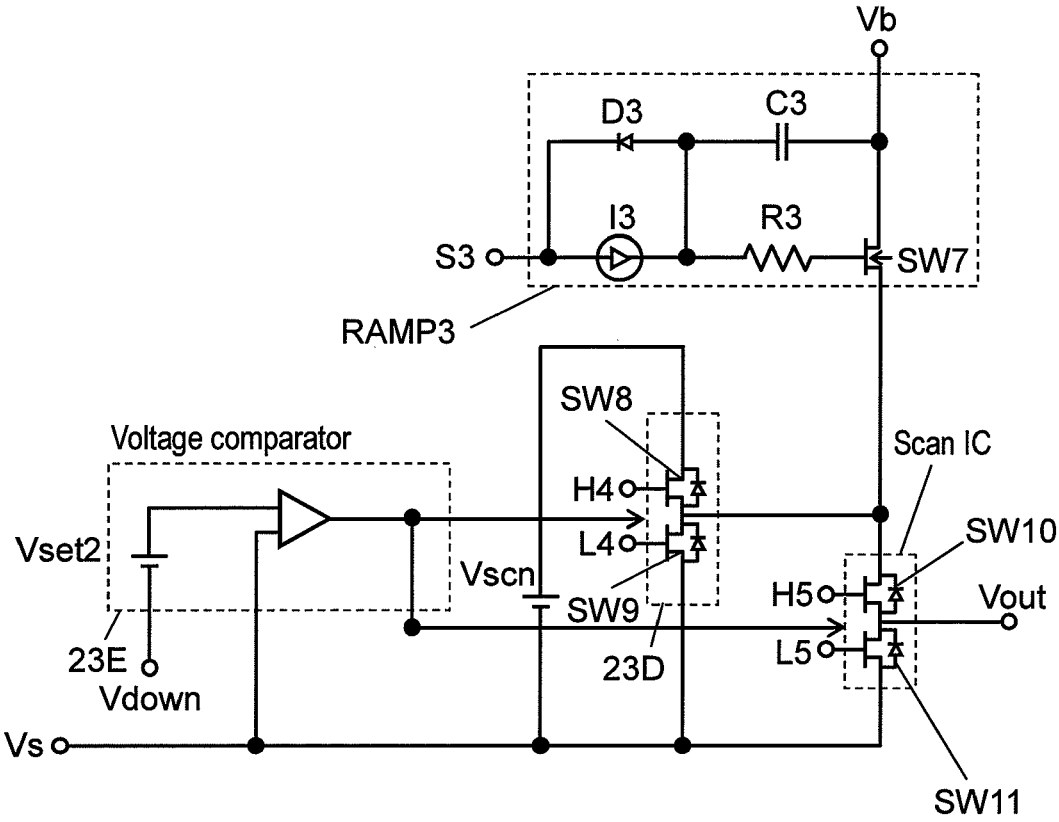
FIG. 23 is a diagram showing one example of a driving circuit for outputting a driving waveform in accordance with a fourth exemplary embodiment of the present invention.
Figure 24:
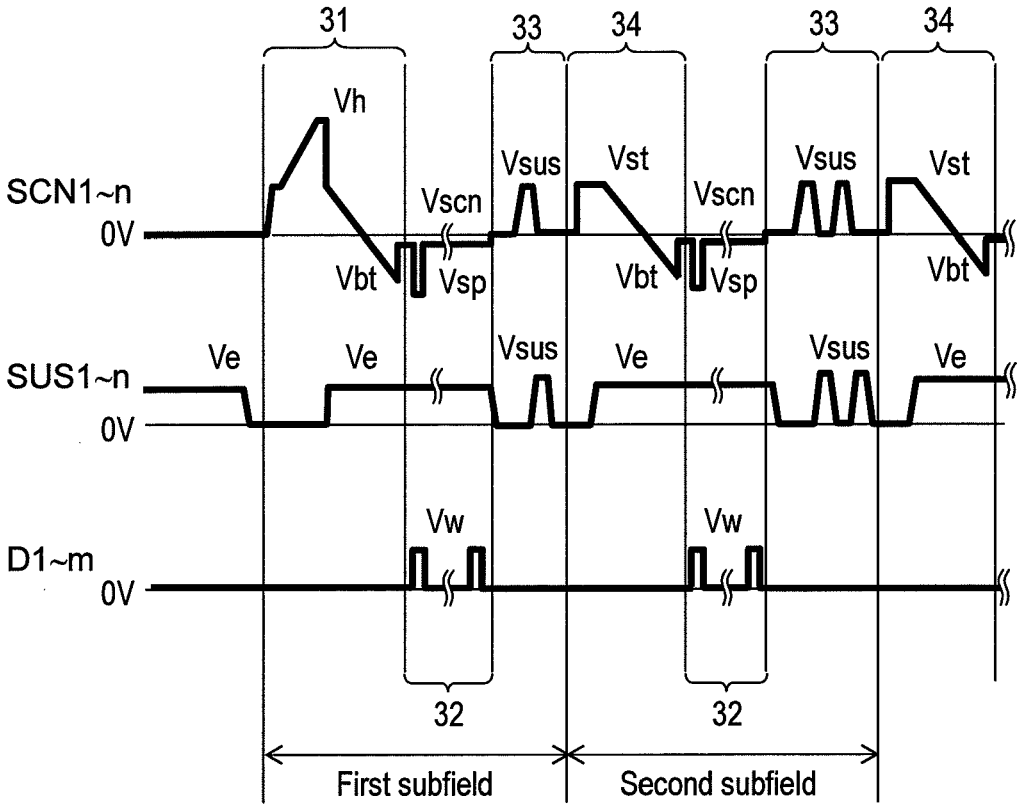
FIG. 24 is an example of a waveform diagram of a conventional driving voltage applied to each electrode of a PDP.

FIG. 23 shows one example of a driving circuit of the third exemplary embodiment. As shown in FIG. 23, the driving circuit of the third exemplary embodiment has a configuration where power supply voltage Vic of a scan IC is used as one of gradually increasing ramp voltages. This driving circuit is formed of four elements, namely ramp generating circuit RAMP3, a scan IC, scan voltage selecting circuit 23D, and scan potential raising circuit 23E. Ramp generating circuit RAMP3 is formed of constant current circuit 13, capacitor C3, diode D3, resistor R3, switch SW7, and power supply voltage Vb. The scan IC is configured by interconnecting high-side switch SW10 and low-side switch SW11 in series. Scan voltage selecting circuit 23D is configured by connecting switch SW8 and switch SW9 to both ends of power supply voltage Vscn for address operation in series. Scan potential raising circuit 23E includes a voltage comparator.

The midpoint between an output terminal of ramp generating circuit RAMP3 and scan voltage selecting circuit 23D is connected to a power supply input terminal of the scan IC. A negative electrode of power supply Vscn and the other end of switch SW9 are connected to a ground (GND) of the scan IC, and also connected to power supply Vs. Voltage is output from the midpoint of the scan IC to scan electrodes 19*a*. Scan ICs are arranged in parallel for respective scan electrodes, and scan voltage selecting circuit 23D is used for controlling ON and OFF of a scan pulse in the address period.

Operation of the driving circuit in the initializing period is described hereinafter. First, only low-side switch SW11 of the scan IC is turned on (accurately, via a diode), and voltage Vs is applied to the scan electrodes. Voltage Vs at this time is 0 V. Next, Hi is input to signal S3, power supply voltage Vb for generating ramp voltage is applied to the scan IC via switch SW7. However, switch SW8, switch SW9, and switch SW10 are in the OFF state, and there is no output to the scan electrodes. During this, voltage Vs is increased sharply from 0 V to Va, and is applied to the scan electrodes. Next, low-side switch SW11 of the scan IC is turned off, and high-side switch SW10 is turned on. At this time, charge current from constant current circuit 13 charges parasitic capacity of switch SW9 and switch SW10. Therefore, before the voltage applied to the scan IC is increased to an operation start voltage, high-side switch SW10 is not turned on and the voltage is kept at Va. When the voltage of the scan IC exceeds the operation start voltage, switch SW10 starts to be turned on, and the voltage applied to the scan IC by charge current becomes ramp voltage and increases from voltage Va to voltage (Va+Vic). After voltage of Vic or higher is applied to the scan IC and switch SW10 is turned on completely, the ramp voltage is output until it becomes voltage Vb by ramp voltage generating circuit RAMP3.

After the ramp voltage arrives at power supply voltage Vb, signal S3 is turned off, switch SW8 is turned on, the voltage is fallen to voltage (Va+Vscn) via switch SW8 and switch SW10. Then, switch SW9 and switch SW11 are turned on, the voltage of scan IC becomes 0 V and falls to voltage Va.

In the above-mentioned circuitry, two periods of different gradient of ramp voltage, and a voltage waveform where the gradient of the backward ramp voltage is gentler than that of forward ramp voltage can be generated. The circuitry of FIG. 23 is one example for outputting ramp voltage having two different gradients, and the present invention is not limited to this.

In the third exemplary embodiment, the gradient of the ramp voltage is set gradually gentle in first half T1 of the initializing period. The opening or closing of a shutter is controlled by a gate signal generator, and the behavior of discharge spreading in the initializing operation is observed from the front face of the panel using a highly sensitive charge coupled device (CCD) camera. As a result, it is cleared in the initializing operation by the ramp voltage that, when the voltage varies from first voltage Va to second voltage Vb, discharge develops from the inside (close to the center of a discharge cell) to the outside (close to the barrier ribs of the discharge cell) of transparent electrodes using the sustain electrodes and address electrodes as negative electrodes and scan electrodes as positive electrodes.

The PDP of the present invention has high electron emission performance and can suppress strong discharge in the initializing operation. However, when discharge spreads outward, surplus electrification occurs in the barrier ribs and in phosphors near the barrier ribs, the address operation after the initializing operation becomes abnormal, and normal image display cannot be performed. Therefore, in the PDP of the present invention, by gradually making the gradient of the ramp voltage gentler, the discharge can be reduced in the time zone when the discharge spreads outward, and the surplus electrification to a side wall can be reduced. In first half T2 of the initializing period, a period when the voltage of the address electrodes has positive polarity is disposed, thereby suppressing the discharge spreading and reducing the surplus electrification to the side wall.

When the gradient of the ramp voltage is increased in the first time zone, the time required for the initializing operation can be shortened and more time can be taken for the address operation related to the stability of image display and sustain operation related to the brightness of an image.

In the plasma display device employing the driving method of the present invention of the PDP of the present invention, preferably, the gradient of the ramp voltage is set at 20 V/μsec or smaller in consideration of the following parameters:

- long-term reliability of protective layer 18 as an electron emission source;
- variation in manufacturing the PDP and the driving circuit;
- image quality degradation due to occurrence of strong discharge in the initializing operation; or
- image quality degradation due to surplus electrification of a side wall.

(Fourth Exemplary Embodiment)

A driving method of still another exemplary embodiment of the present invention is hereinafter described. The driving method of the fourth exemplary embodiment differs from the driving method of the third exemplary embodiment in that scan potential raising circuit 23E is removed and the scan pulse potential applied to the scan electrodes is the same potential as fourth voltage Vd in the circuitry of the driving circuit of FIG. 23. In the PDP of the present invention, the charge retention performance is stable, and loss of the wall charge in the pause period for waiting the address operation is small, so that voltage Vset2 applied for compensating the voltage corresponding to the lost charge can be omitted in some case. In this case, scan potential raising circuit 23E can be omitted, and a plasma display device of low cost can be provided.

As is clear from the above-mentioned description, the plasma display device of the present invention has an effect of increasing the density of charged particles or excitation particles (hereinafter referred to as "priming particles") initially existing in the discharge section, and suppressing the strong discharge for extremely reducing the contrast ratio in the initializing period before the address period.

The plasma display device of the present invention also has an effect of reducing the influence of electric field interference between adjacent cells and scattering of charged particles in the selective initializing period, and suppressing the image quality degradation due to a selection failure of a lit cell or unlit cell in the address period.

Also when the number of scan lines is increased by improvement in definition, the address failure due to discharge delay is suppressed, the address operation can be performed at a high speed, and the image quality is improved by improvement in definition.

After the completion of the initializing operation, the charge decreasing in the waiting period until the address operation can be prevented, and the scan voltage and the address voltage applied in the address period can be reduced. Thus, the number of components of the scan IC and the address electrode driving circuit can be reduced, and a PDP of lower cost can be provided. Thanks to the effect of suppressing the strong discharge in the initializing operation, the effect of preventing the charge decreasing, and the effect of suppressing the discharge delay, the mixing ratio of gas such as xenon or krypton having a large atomic number and the whole pressure of the discharge gas can be increased. Thus, a plasma display device of high luminance, high efficiency, and power saving can be provided.

Industrial Applicability

The plasma display device of the present invention has, on a protective layer, a crystal particle layer made of MgO single crystal where CL emission spectrum shows a desired characteristic. In the driving method, the initializing period has the first half for applying the voltage, which gradually increases from a first voltage and to a second voltage, to a second electrode, and the latter half for applying the voltage, which gradually decreases from a third voltage and to a fourth voltage, to the second electrode. The plasma display device of the present invention is useful as an image display device for displaying an image at a high image quality. The plasma display device of the present invention can be applied to an image display device or the like using a plasma display and full-spec high vision plasma display where the efficiency is improved by increase in Xe partial pressure ratio and increase in whole pressure.

The invention claimed is:

1. A plasma display device comprising:

a plasma display panel including:

a pair of electrodes including a first electrode and a second electrode;

a dielectric layer formed so as to cover the first electrode and the second electrode;

a protective layer formed so as to face a discharge section on a surface of the dielectric layer;

a first substrate including a part facing the discharge section on the surface of the dielectric layer;

a second substrate including a third electrode and a dielectric layer formed so as to cover the third electrode; and a driving circuit for driving the plasma display panel by a driving method, wherein the first substrate is positioned so as to face the second substrate, wherein a discharge gas is filled between the first substrate and the second substrate, wherein the protective layer includes:

a base protective layer formed of a thin film containing a metal oxide; and a particle layer formed by discretely sticking, to the base protective layer, agglomerated particles in which a plurality of single-crystal particles of magnesium oxide are aggregated by static electricity between the plurality of single-crystal particles of magnesium oxide and are distributed across the entire surface of the base protective layer, wherein the plurality of single-crystal particles of magnesium oxide have a ratio Sa/Sb of 1 or higher, where Sa is a spectral integrated value of a wavelength region of 200 nm or higher and lower than 300 nm in cathode luminescence, and Sb is a spectral integrated value of a wavelength region of 300 nm or higher and lower than 550 nm;

wherein, in the driving method, one field is formed of a plurality of subfields, wherein each of the subfields includes an initializing period and an address period, and wherein the initializing period includes (i) a first half of the initializing period for applying voltage, which gradually increases from a first voltage and to a second voltage, to the second electrode, and (ii) a second half of the initializing period for applying voltage, which gradually decreases from a third voltage and to a fourth voltage, to the second electrode.

2. The plasma display device of claim 1, wherein the plurality of single-crystal particles of magnesium oxide have a ratio Sc/Sd of 2 or higher, where Sc is a spectral maximum value of a wavelength region of 200 nm or higher and lower than 300 nm in cathode luminescence, and Sd is a spectral maximum value of a wavelength region of 300 nm or higher and lower than 550 nm in the cathode luminescence.

3. The plasma display device of claim 1, wherein the plurality of single-crystal particles of magnesium oxide have an average diameter of 0.3 μm or larger and 4 μm or smaller.

4. The plasma display device of claim 1, wherein an area of the agglomerated particles in which the plurality of single-crystal particles of magnesium oxide are aggregated by static electricity is smaller than a whole area of the first substrate facing the discharge section on the surface of the dielectric layer.

5. The plasma display device of claim 1, wherein a part of the plurality of single-crystal particles of magnesium oxide is buried and disposed in the base protective layer to form the particle layer.

6. The plasma display device of claim 1, wherein the first half of the initializing period has two or more periods of different up voltage gradients, and wherein in the two or more periods, a later period has gentler gradient than an earlier period.

7. The plasma display device of claim 1, wherein the second half of the initializing period has two or more periods of different down voltage gradients, and wherein in the two or more periods, a later period has gentler gradient than an earlier period.

* * * * *